US005794205A

United States Patent [19]

Walters et al.

[11] Patent Number: 5,794,205

[45] Date of Patent: Aug. 11, 1998

[54] VOICE RECOGNITION INTERFACE APPARATUS AND METHOD FOR INTERACTING WITH A PROGRAMMABLE TIMEKEEPING DEVICE

[75] Inventors: Timothy L. Walters, San Diego; Anil K. Agarwal, Poway, both of Calif.

[73] Assignee: Voice It Worldwide, Inc., Fort Collins, Colo.

[21] Appl. No.: 545,538

[22] Filed: Oct. 19, 1995

[51] Int. Cl.[6] ..... G10L 3/00

[52] U.S. Cl. ..... 704/275; 704/276

[58] Field of Search ..... 368/63; 704/270, 704/272–276, 246

[56] References Cited

U.S. PATENT DOCUMENTS

| | | | |
|---|---|---|---|
| 3,637,952 | 1/1972 | Hataya et al. | 360/12 |
| 3,855,574 | 12/1974 | Welty | 340/309.15 |
| 3,875,738 | 4/1975 | Ichikawa et al. | 368/250 |
| 3,919,834 | 11/1975 | Murakami et al. | 368/63 |
| 4,368,988 | 1/1983 | Tahara et al. | 368/63 |
| 4,391,530 | 7/1983 | Wakabayashi et al. | 368/63 |
| 4,405,241 | 9/1983 | Aihara et al. | 368/63 |
| 4,406,549 | 9/1983 | Takahashi | 368/63 |
| 4,480,253 | 10/1984 | Anderson | 395/2.67 |
| 4,525,076 | 6/1985 | Takebe | 368/63 |
| 4,545,686 | 10/1985 | Ushikoshi | 368/63 |
| 4,573,134 | 2/1986 | Ikemoto | 368/63 |
| 4,835,520 | 5/1989 | Aiello | 340/545 |
| 5,014,317 | 5/1991 | Kita et al. | 395/2.83 |
| 5,297,110 | 3/1994 | Ohira et al. | 368/110 |
| 5,444,673 | 8/1995 | Mathurin | 368/63 |

FOREIGN PATENT DOCUMENTS

| | | | |
|---|---|---|---|
| WO 94/02936 | 2/1994 | WIPO . | |
| WO 94/03020 | 2/1994 | WIPO . | |
| WO 95/06309 | 3/1995 | WIPO . | |
| WO 95/10833 | 4/1995 | WIPO | 395/2.84 |

*Primary Examiner*—David R. Hudspeth
*Assistant Examiner*—Patrick N. Edouard
*Attorney, Agent, or Firm*—Mueting, Raasch & Gebhardt, P.A.

[57] ABSTRACT

A voice recognition interface apparatus and method for interacting with a programmable timekeeping device is disclosed. The voice recognition interface includes a display for displaying time, alarm, calendar, and other information, and also includes a microphone and a speaker for facilitating verbal communication between a user and the programmable timekeeping device. A number of illuminatable annunciators are provided on the display for visually communicating prompts to the user. Programming, querying, and other interactive operations are facilitated through use of the voice recognition interface generally by producing a visual prompt to invoke a particular verbal input from the user, receiving the verbal input by use of the microphone, validating the verbal input against a pre-established recognition word library, verbally confirming the verbal input by broadcasting over a speaker pre-synthesized words and phrases retrieved from a message word library, and displaying or otherwise broadcasting information associated with the particular programming, querying, or other interactive operation. The voice recognition interface includes a logic controller that controls and cooperates with a memory, a voice recognition device, a display, and a clock circuit to provide an intuitive voice-driven programming and querying interface for interacting with a programmable timekeeping device. Manually actuatable control switches are also provided for enhancing programming and querying operations. Advanced features include a personal message recording and playback capability, multiple programmable alarms for activating personalized alarm messages, and user-modifiable verbal prompts for personalizing the voice recognition interface dialogue.

22 Claims, 12 Drawing Sheets

FIG. 12

MESSAGE SETS

MSG – A: "WELCOME TO VOICE–IT PROGRAMMABLE CLOCK, DOUBLE TAP TIME, ALARM, OR SNOOZE TO ENTER SET UP MODE"
MSG – B: "DID YOU SAY YES OR NO ?"
MSG – C: "CURRENT TIME IS SIX FIFTEEN AM"
MSG – D: "ALARM IS TURNED ON OR OFF FOR SIX FIFTEEN AM"
MSG – E: SNOOZE TIME IS FIVE MINUTES"

SYNTHESIZED WORDS

ONE, through TWENTY, THIRTY, FORTY, FIFTY
AM, PM, INTERNATIONAL, ALARM, SNOOZE, CURRENT, TIME
YES, NO,
MINUTES, ON, OFF, SET, RESPONSE

ROUTINES

R–1: SEARCHING VOCABULARY SETS
R–2: VALIDATING AND VERIFYING QUESTIONABLE VERBAL INPUTS
R–3: ENTERING NUMBER SETS
R–4: SUCCESSIVE EXITING THROUGH PROGRAM
R–5: SETTING VALUES FOR SUB–BRANCHES OF PROGRAM

VOICE RECOGNITION INTERFACE APPARATUS AND METHOD FOR INTERACTING WITH A PROGRAMMABLE TIMEKEEPING DEVICE

FIELD OF THE INVENTION

The present invention relates generally to voice recognition interfaces, and more particularly, to a voice recognition interface for a programmable timekeeping device.

BACKGROUND OF THE INVENTION

Recent advancements in voice recognition technology have resulted in the development of computer-based speech recognition and response hardware and software adaptable for use in a wide range of commercial and consumer applications. A number of computer-based voice recognition and response systems have been developed for use on relatively high-speed computer workstations that typically employ sophisticated signal processing and data management techniques to provide reliable voice recognition and response capabilities. State-of-the-art voice typewriters, for example, represent one emerging computer-based voice recognition and response application that promises to provide for the recognition of a moderate number of commonly used words and phrases. These and other known computer-based voice recognition systems, however, are typically expensive, application specific, and generally ill-suited for use in many commercial and consumer product applications.

In addition to advancements in computer-based voice recognition and response systems, integrated circuit (IC) manufacturers are currently expending appreciable research and development resources in an effort to develop low-cost, compact electronic devices capable of performing rudimentary and moderately sophisticated voice recognition and response operations. The continuing development of new generations of relatively compact speech recognition and synthesis IC devices, for example, has enabled product developers the opportunity to explore voice recognition as a means of controlling and interacting with conventional electronic products, which heretofore have traditionally been controlled through the use of manually actuatable switches, buttons, and knobs. In view of the number and diversity of commercial and consumer products made available in the marketplace, it can be appreciated that a considerable amount of development time and capital is generally expended by the manufacturers of such products in order to provide controls and control interfaces that can readily be understood and manipulated by the average consumer.

In general, an economically successful product is typically one that can easily and intuitively be controlled and operated by the average consumer. This "human" design constraint, however, significantly limits the extent to which a manufacturer can incorporate advanced features and functionality into a product. Although widely available, state-of-the-art electronic components would appear to offer only a partial solution in view of this inherent "human" design constraint. In many cases, conventional switches, buttons, and knobs are reluctantly integrated into a product design in order to ensure that the average consumer will be capable of understanding the manner in which the product is to be controlled and operated, even at the expense of eliminating desirable features and functionality.

For example, a popular line of commercial and consumer products generally manufactured using low-cost electronic components includes programmable digital timekeeping devices, such as digital clocks, watches, and timers.

Although many manufactures of such timekeeping products often employ low-cost digital IC components to provide the requisite time base, conventional switches, buttons, and knobs are typical employed to provide an easy-to-understand means for manually controlling and operating the timekeeping device. It is generally understood that timekeeping devices employing relatively complicated control schemes, as well as those requiring an inordinate amount of time and effort to manipulate, are often perceived to be less desirable to the average consumer when compared to competing devices that offer a relatively simplistic and readily understandable means for interacting with the timekeeping product.

Other consumer products have been developed that purport to provide a convenient and effective voice recognition capability for controlling the product. One such device, termed a Voice Activated Personal Organizer, is disclosed in International Application PCT/US94/10392 (referred to hereinafter as "the '392 application") filed Sep. 15, 1994 (International Pub. No. WO 95/10833; International Pub. date of Apr. 20, 1995). The Voice Activated Personal Organizer is disclosed as a hand-held personal organizer that is controlled using a computer that is programmed for speech recognition. The disclosed voice recognition capability, however, is severely limited, and only provides for voice recognition of a single user's speech patterns. Further, an elaborate voice recognition training procedure must be fully completed in order to utilize any of the device's voice recognition features.

The voice recognition training procedure disclosed in the '392 application must be fully carried out for each of a pre-defined number of words or templates that are utilized in accordance with a rigidly structured control program. The elaborate voice training procedure is initiated by pressing a "train" button followed by the displaying of a word on a display provided on the device. A user utters the displayed word and a template of the uttered word is stored. This process is repeated for each of the predefined number of words until the last word is stored in this manner. When the template for the last word in the list is collected, a user is required to repeat the process of uttering each of the words successively displayed on the display in order to generate a collection of second templates. As each of the second templates is collected, the instant second template is compared to the previously collected corresponding first template for a particular word. If a comparison between the first and second collected templates is within an acceptable degree of deviation, then the second template for the word is saved. If the first and second templates differ beyond the acceptable degree of deviation, the second template is discarded and the user is prompted by the display to re-utter the word in order to collect a third template.

This process for each word is repeated until there are two templates for each word that match within an acceptable degree of deviation. Thus, for each of the words to be utilized for purposes of voice recognition by the Voice Activated Personal Organizer disclosed in the '392 application, this elaborate and laborious training procedure must be fully performed before any of the voice recognition functions become operable. It is further indicated in the '392 application that this elaborate training procedure must be repeated to correct problem words that are not being properly recognized by the device. The user must then initiate retraining of the problematic word or words, or has an option to perform retraining for all of the word templates utilized by the '392 device.

The '392 device further includes a timekeeping capability. The limitations inherent in the voice recognition capability of the '392 device are further made evident by the disclosed manner by which a user interacts with the timekeeping capability of the device. In short, programming the clock functions of the '392 device involves manually pressing various buttons to advance individual time characters presented on a display in order to program the desired time. Thus, the voice recognition capability of the '392 device is not employed in any respect when programming or interacting with the device's clock functions. Calendar information is manually programed in a similar manner by properly advancing each of the applicable date display fields to a desired value. As such, manual programming of the calendar and date functions, as well as various timer-type settings, must be manually programmed in a manner similar to the procedure of manually programming various time parameters.

It can be appreciated that a voice recognition capability that requires such a laborious method of training, or one that is responsive only to a single user's particular speech characteristics, is of little value for use in products designed to be used by one user or by numerous individual users. Also, currently available voice recognition products often employ a voice recognition capability that is inflexible to modification by a user, typically unresponsive to all but a single user, and are generally incapable of being customized as desired by a user.

There exists a need for an intuitive interface for interacting with a programmable timekeeping device. There exists a further need for such an interface that is relatively inexpensive, requires minimal power, and has a relatively small packaging configuration for use in compact and portable programmable timekeeping devices. The present invention fulfills these and other needs.

SUMMARY OF THE INVENTION

The present invention is a voice recognition interface apparatus and method for interacting with a programmable timekeeping device. The voice recognition interface includes a display for displaying time, alarm, calendar, and other information, and also includes a microphone and a speaker for facilitating verbal communication between a user and the programmable timekeeping device. A number of illuminatable annunciators are provided on the display for visually communicating prompts to the user. Programming, querying, and other interactive operations are facilitated through use of the voice recognition interface generally by producing a visual prompt to invoke a particular verbal input from the user, receiving the verbal input by use of the microphone, validating the verbal input against a pre-established recognition word library, verbally confirming the verbal input by broadcasting over a speaker pre-synthesized words and phrases retrieved from a message word library, and displaying or otherwise broadcasting information associated with the particular programming, querying, or other interactive operation. The voice recognition interface includes a logic controller that controls and cooperates with a memory, a voice recognition device, a display, and a clock circuit to provide an intuitive voice-driven programming and querying interface for interacting with a programmable timekeeping device. Manually actuatable control switches are also provided for enhancing programming and querying operations. Advanced features include a personal message recording and playback capability, multiple programmable alarms for activating personalized alarm messages, and usermodifiable verbal prompts for personalizing the voice recognition interface dialogue.

BRIEF DESCRIPTION OF THE DRAWINGS

FIG. 12 is an illustrative listing of message sets, synthesized words, and processing routines associated with various voice recognition interfacing method steps.

DETAILED DESCRIPTION OF THE PREFERRED EMBODIMENTS

Figure 1:
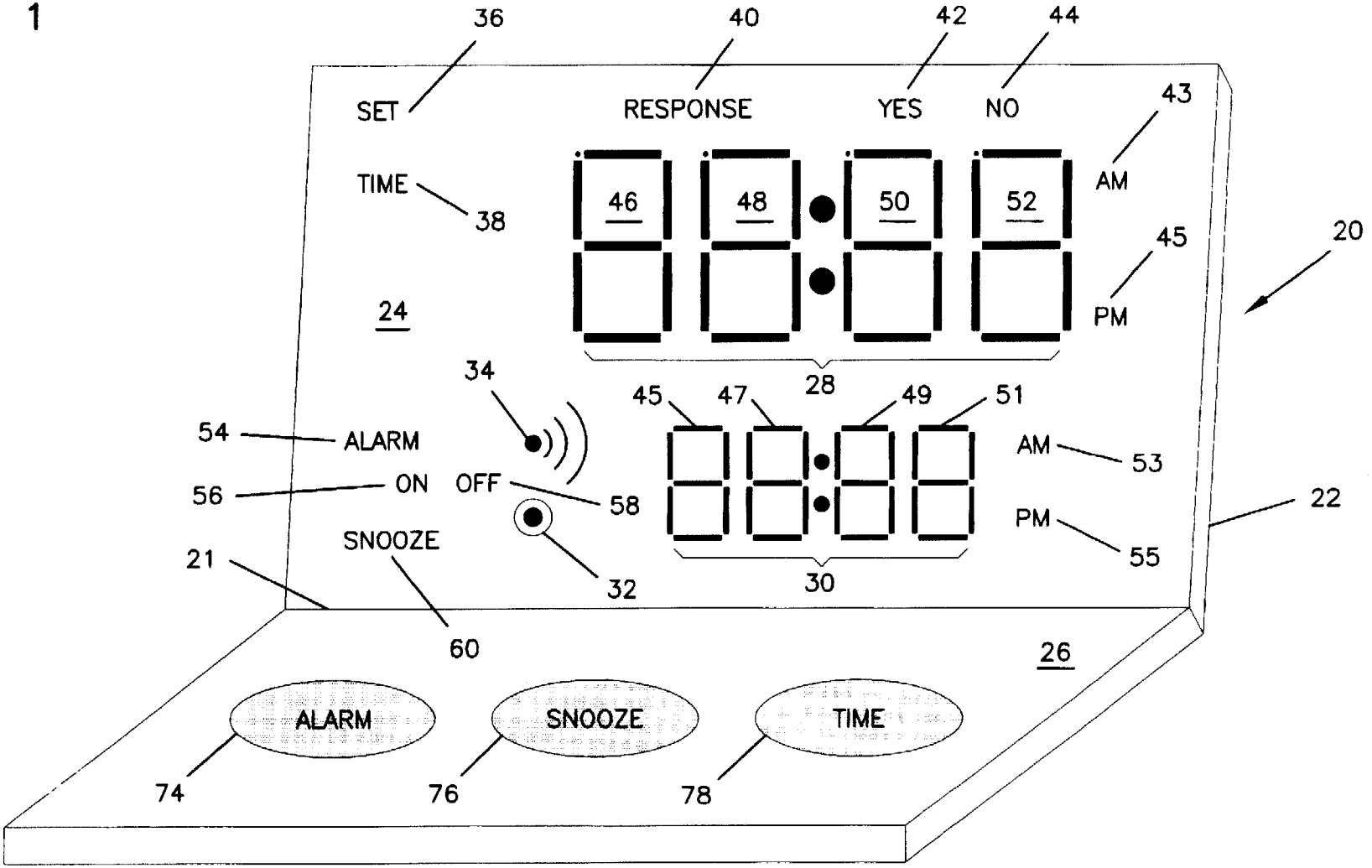
FIG. 1 is an illustration of a programmable timekeeping device employing a novel voice recognition interface for facilitating programming, querying, and other user-interactive operations.
Figure 2:
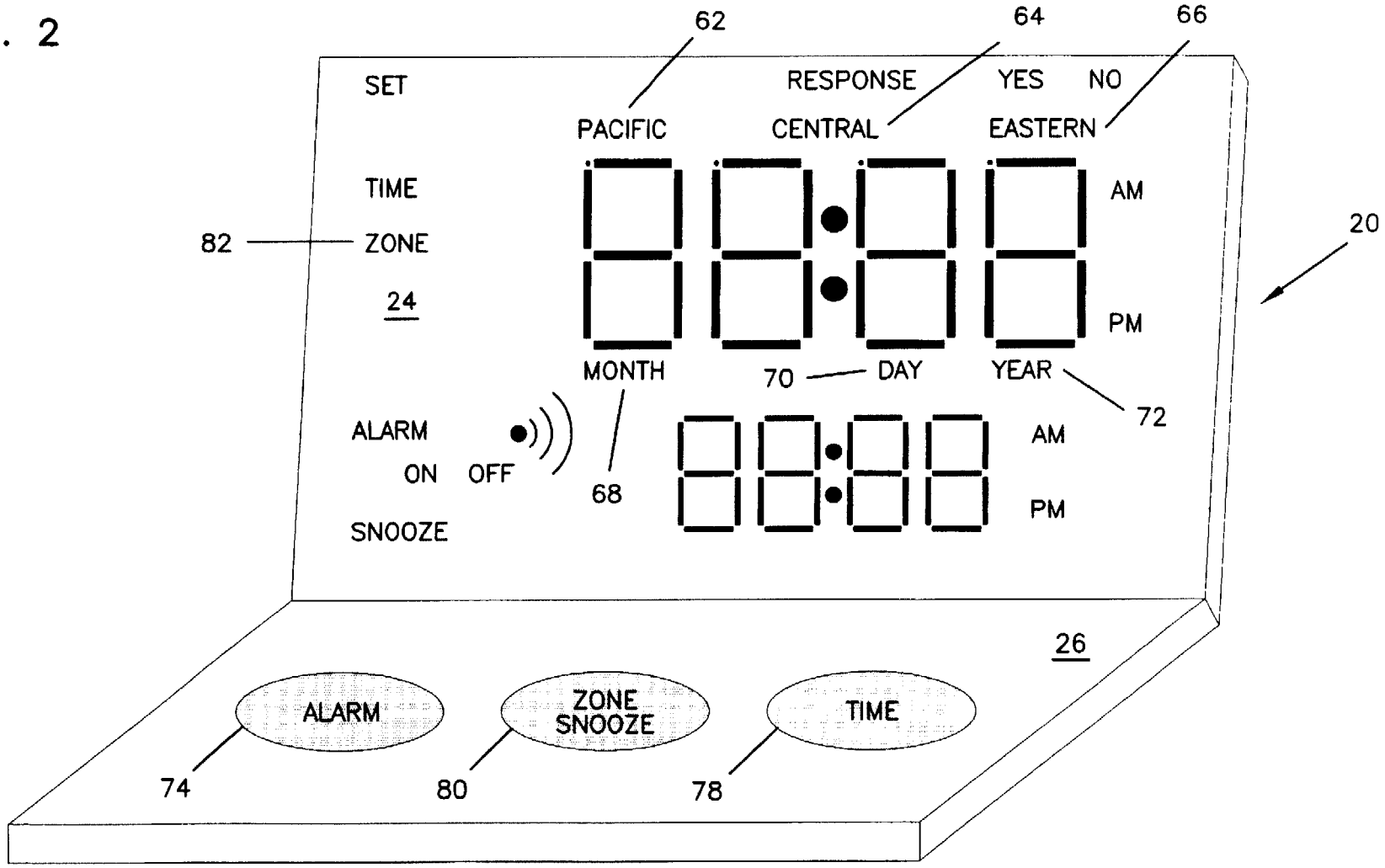
FIG. 2 is an illustration of an alternative embodiment of the programmable timekeeping device employing a novel voice recognition interface shown in FIG. 1.
Figure 3:
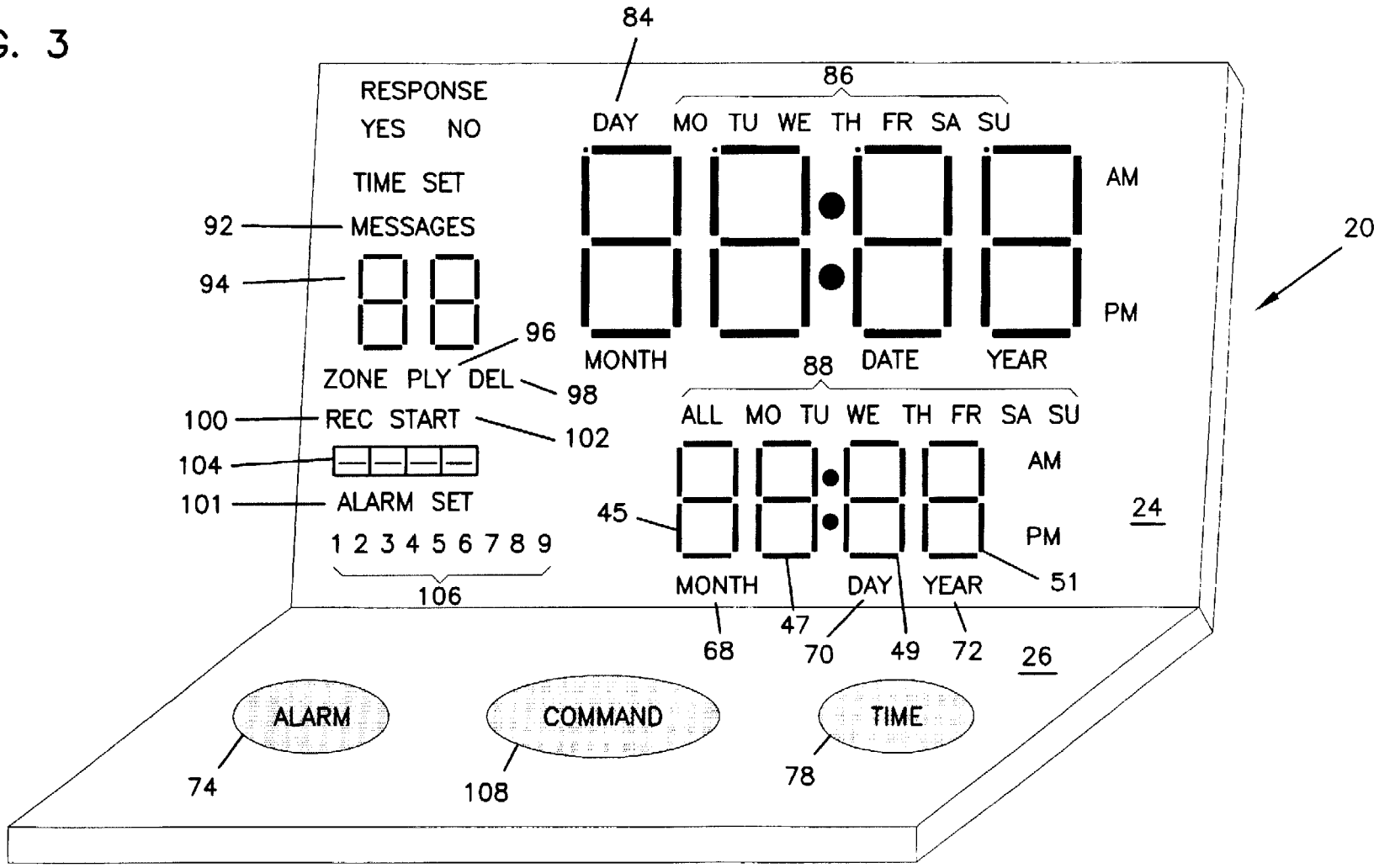
FIG. 3 is an illustration of another embodiment of the programmable timekeeping device employing a novel voice recognition interface shown in FIG. 1, which includes a message recording and playback capability.

Referring now to the drawings, and more particularly, to FIGS. 1–3, there is illustrated several embodiments of a programmable clock 20 employing a novel voice recognition interface. In general, the embodiments provided for purposes of illustration in FIGS. 1–3 provide for speech-based interfacing with a programmable clock 20 as a preferred approach, but include various manually actuatable switches for enhancing and overriding various programming and querying functions. The novel voice recognition interface substantially enhances the convenience and ease by which a user interacts with a digital timekeeping device. For example, a user can request the current time, set various alarms, turn alarms off and on, and perform a number of other programming and querying functions as described herein simply by issuing the appropriate voice commands. Further, a user may access basic and advanced programmable clock 20 features by navigating intuitively through verbal menus and by responding to synthesized and pre-recorded verbal prompts and messages. Other advanced features include, for example, establishing geographic time zones for travel purposes, programming multiple alarms, establishing a Julian calendar for past, present, and future planning, and various querying capabilities to verbally access information about past, present, and future events.

Among the numerous advantages provided by the novel voice recognition interface and programmable clock 20 as depicted in FIGS. 1–3, user interaction with the programmable clock 20 is significantly enhanced by features such as user-independent voice recognition of voice commands; user-dependent voice recognition for particular operations; navigation through menus of options using voice commands; feedback loops for confirming voice commands; synthesized speech for verbal output; ability to record messages to be played as alarms; ability to record messages to be used as standard feedback verbal prompts and to replace previously programmed verbal prompts; verbal queries for reviewing categories of information such as birthdays and holidays; recording, reviewing, and editing personal messages; and providing user-dependent security.

In accordance with the embodiment illustrated in FIG. 1, the programmable clock 20 includes an interface display panel 24 for effectuating verbal and visual communication between a user and the programmable clock 20. The interface display panel 24 preferably includes a microphone 32 and a speaker 34 for respectively receiving and broadcasting verbal and other audio information when programming, querying, and generally interacting with the programmable clock 20. Additionally, the interface display panel 24 preferably includes a time display 28, an alarm display 30, and various user interface annunciators for communicating visual prompts, commands, and interface status information to the user.

The novel voice recognition interface provides a user with the capability to verbally interact with the programmable clock 20 in a plurality of interface modes, including a query mode of operation and a programming mode of operation. By way of example, a user may verbally query the programmable clock 20 for the current time or date by issuing an appropriate verbal query command, such as "CURRENT TIME" or "CURRENT DATE," respectively. In response to a verbal query command, the voice recognition interface preferably interprets the verbal command and broadcasts the requested information to the user using synthesized speech. Further, a user may verbally program and modify various clock, date, and alarm parameters, including the current time, date, time-zone, and a plurality of alarms and associated alarm messages and sounds, for example. Additionally, the verbal prompts by which the voice recognition interface communicates specific verbal instructions and information to a user may themselves be modified by the user to provide a personalized or customized interface for interacting with the programmable clock 20.

An important advantage of the voice recognition interface concerns a novel verbal input validation procedure by which a user's verbal input is compared against a recognition word library residing a memory of the voice recognition interface. In one embodiment, each of the user's verbal inputs is compared with a set of predefined validation words defining a recognition word library. A high probability match between the verbal input and a validation word contained in the recognition word library represents a valid user input, which subsequently results in illumination of a character representative of the verbal input on the interface display panel 24. A low probability matching condition preferably results in the initiation of a verbal input verification procedure by which the voice recognition interface broadcasts a confirmatory message requesting confirmation of the verbal input. For example, a validation word residing in the recognition word library that most closely resembles the user's verbal input is preferably broadcasted over the speaker 34, together with a message requesting that the user verify whether the estimated matching word is equivalent to the user's verbal input. The user preferably verifies the accuracy of the estimated verbal input by a suitable response, such as "Yes" or "No," in response to the illuminated RESPONSE annunciator 40 and the flashing YES and NO annunciators 42 and 44. Accordingly, the verbal input validation capability of the voice recognition interface provides for a high-degree of integrity with respect to the verbal information received from a user.

In broad and general terms, and as developed in detail hereinbelow, interaction with the programmable clock 20 is preferably effectuated by exclusive use of the novel voice recognition interface, preferably without having to operate any manual actuatable switches that may be provided to augment the operation of the voice recognition interface. The voice recognition interface provides for recognition and communication of verbal prompts, phrases, commands, and instructions between the programmable clock 20 and the user. At any time during a verbal dialogue with the programmable clock 20, however, the user may interrupt, override, or otherwise modify querying or programming operations simply by issuing an appropriate verbal command or by manually actuating an appropriate switch provided on the base 26 or interface display panel 24 of the programmable clock 20.

In accordance with the illustrative embodiment shown in FIG. 1, the base 26 of the programmable clock 20 preferably includes a plurality of switches which generally augment the operation of the voice recognition interface. In the embodiment illustrated in FIG. 1, for example, an alarm switch 74, a snooze switch 76, and a time switch 78 are respectively mounted to the base 26. Corresponding alarm annunciator 54, snooze annunciator 60, and time annunciator 38 are respectively provided on the interface display panel 24. Interfacing with the programmable clock 20 in accordance with this embodiment is preferably initiated by actuation of any one of the alarm 74, snooze 76, or time 78 switches. The switches 74, 76, and 78 are preferably dual-mode switches which actuate a first function upon being depressed or tapped a first time, and actuate a second function upon being depressed or tapped two consecutive times.

The embodiment illustrated in FIG. 1 thus provides a user-friendly, intuitive interface for interacting with the programmable clock 20 which requires virtually no pre-knowledge as to the operation of the clock 20 or any verbal commands associated with interacting with the clock 20. For example, a user may simply depress the time switch 78 once in order for the current time to be verbally broadcast over the speaker 34. Single depression of the snooze button 76, by way of further example, provides a user with a verbal indication of the preset snooze duration associated with a particular alarm.

In general, a user interacts with the programmable clock 20, or other digital timekeeping device employing the novel voice recognition interface, preferably by perceiving visual, verbal, or a combination of visual and verbal prompts, provided by the interface display panel 24, and responding in accordance with a prompt typically by providing an appropriate verbal input. The coordinated operations of displaying visual annunciators provided on the interface display panel 24 and broadcasting verbal prompts and instructions broadcasted over the speaker 34 permits users of varying sophistication the ability to efficiently program and query the programmable clock 20. In one embodiment, programming an alarm is preferably initiated by double tapping the alarm switch 74. The SET and ALARM annunciators 36 and 54 are preferably illuminated on the interface display panel 24 in response to double depression of the alarm switch 74. A confirmatory message such as "Programming Alarm" may be broadcast to verify the user's present intention to program or modify an alarm. At any time, a user may terminate a particular programming or querying operation preferably by verbalizing an appropriate termination command, such as "Exit" or "Terminate," or, alternatively, by double tapping the alarm switch 74.

The available functions associated with programming the selected alarm are preferably conveyed to the user by flashing the alarm annunciators representative of the available alarm functions on the interface display panel 24, such as the SET 36, ON 56, and OFF 58 annunciators. Selecting one of the flashing alarm functions is preferably accomplished by vocalizing one of the flashing annunciators. For example, a user may vocalize the word "On" to enable or turn-on the alarm for activation at a predetermined time. After the verbal input of the word "On" is received by the voice recognition interface, the ON annunciator 56 preferably transitions from a flashing state to a solid or constant illumination state. All other annunciators, such as the SET and OFF annunciators 36 and 58, are preferably de-energized as the ON annunciator 56 transitions to the constant illumination state.

Programming the desired alarm activation time preferably involves flashing the tens-of-hours display character 45 of the alarm display 30, receiving an appropriate verbal input from the user, verifying the validity of the user's verbal input, and then illuminating at a constant illumination state the character representative of the validated verbal input in the tens-of-hours display 45. After successfully programming the tens-of-hours display character 45, the hours display character 47 is similarly programmed. A user preferably responds to the initially flashing hours display character 47 by verbally inputting an appropriate hours selection. Successful validation of the verbal input is followed by fully illuminating the character representative of the validated user input in the hours display 45. The minutes display character 49 and tens-of-minutes display character 51 are then programmed in a similar manner. After programming the tens-of-minutes character 51, the user preferably selects between the flashing A.M. and P.M. annunciators 53 and 55 by verbally inputting the word "AM" or "PM" into the microphone 32.

By way of further example, and with reference to FIGS. 1–4, a user preferably initiates programming of the current clock time by manually depressing the time switch 78, or, alternatively, by verbally initiating the clock time programming process. The initiation of the clock time programming process is preferably visually conveyed to the user by illumination of the SET annunciator 36 and the TIME annunciator 38. The interface display panel 24 prompts a user to input each of the time parameters that define the current clock time preferably by successively flashing each of the time display characters defining the time display 28, receiving a verbal input from the user, validating the verbal input, verbally confirming the user's input, and then illuminating at a constant illumination state a character in the time display 28 representative of the user's validated verbal input.

For example, the tens-of-hours display character 46 is initially transitioned from a non-illuminated or de-energized state to a flashing state to visually prompt the user for an appropriate tens-of-hours verbal input parameter. It is noted that the hours, tens-of-minutes, and minutes display characters 48, 50, and 52 are preferably initially de-energized during flashing of the tens-of-hours display character 46. The RESPONSE annunciator 40 is preferably illuminated during flashing of the tens-of-hours display character 46 to further visually convey to the user that a verbal response is being requested. Illumination of the RESPONSE annunciator 40 may be delayed by a predefined time duration, such as five seconds, after initiating flashing of the tens-of-hours display character 46, or may be flashed in sequence or out of sequence with the flashing tens-of-hours display character 46 to further indicate that a user input is being requested.

Upon receiving a verbal input from the user in response to the visual prompting, a validation procedure is commenced by which the user's verbal input is compared with a recognition word set specifically associated with the tens-of-hours display character 46. For example, the tens-of-hours recognition word set 23 depicted in FIG. 4 defines a set of validation words against which a user's verbal input is compared. The words "zero," "one," and "two" define the totality of validation words associated with the tens-of-hours recognition word set 23. As such, the voice recognition interface considers a verbal input other than "zero," "one," and "two" as an invalid verbal input in response to a tens-of-hours prompt. An error message such as "Invalid Input" may then be broadcasted over the speaker 34. Additionally, a message indicating a range of valid inputs, or, alternatively, a verbal listing of all valid inputs associated with a particular recognition word set may be broadcasted to the user.

In response to a valid verbal input, the voice recognition interface preferably broadcasts a confirmatory verbal prompt requesting the user to verify the accuracy of the received verbal input. A user's verbal input of "One" in response to a tens-of-hours display character 46 prompt, for example, is preferably followed by broadcasting a confirmatory verbal message of "Did You Say One." The RESPONSE annunciator 40 is preferably illuminated, along with flashing of the YES and NO annunciators 42 and 44, to invoke either a "Yes" or a "No" verbal response from the user. In response to a verbal input of "Yes," the tens-of-hours display 46 is illuminated with a "1" character, and the hours display character 48 is transitioned to a flashing state, thus prompting the user to next program the hours display character 48. The RESPONSE, YES, and NO annunciators 40, 42, and 44 are then de-energized to a non-illuminated state.

Programming of the hours time parameter is preferably accomplished in a similar manner by flashing the hours display character 48 and receiving a verbal input from the user. The user's verbal input is preferably validated by comparing the verbal input with an hours recognition word set 25. In contrast to the tens-of-hours recognition word set 23, the hours recognition word set 25 includes a totality of ten validation words, namely, the words "zero" through "nine." An invalid verbal input is detected when the user's verbal input does not match any of the ten validation words defining the tens-of-hours recognition word set 25. A verbal error message, such as "Invalid Entry, Please Provide a Valid Input between Zero and Nine" is preferably broadcasted to the user. After programming the tens-of-hours and hours time parameters, the tens-of-minutes and minutes time parameters are programmed in a similar manner.

Figure 4:
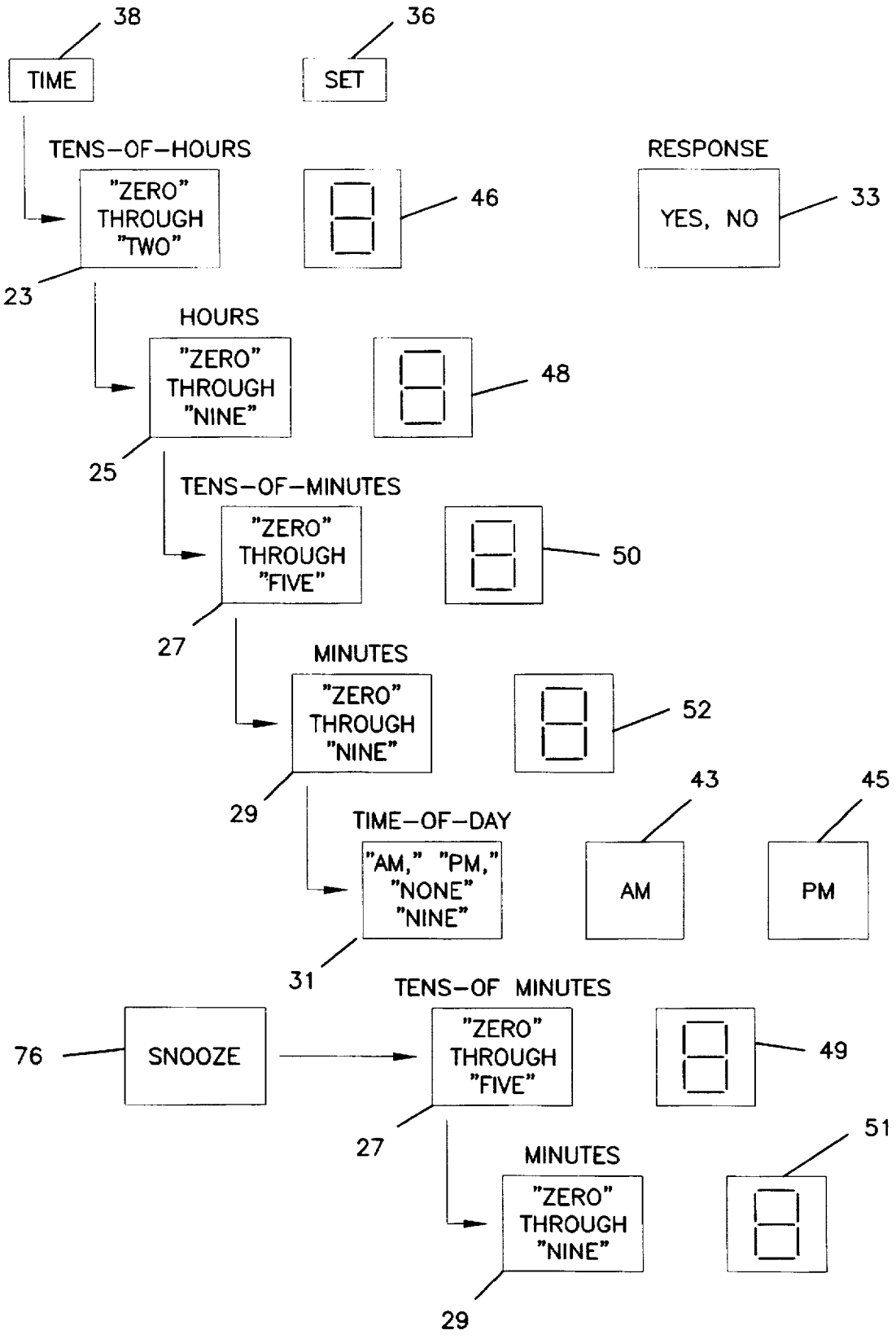
FIG. 4 is a depiction of various time display parameters and associated validation words contained in recognition word sets defined for each of the time display parameters.

As is illustrated in FIG. 4, each of the programmable clock 20 time and operational parameters has associated with it a corresponding predefined recognition word set that is accessed when the voice recognition interface validates a user's verbal input. For example, a tens-of-minutes recognition word set 27 includes the words "zero" through "five," while the minutes recognition word set 29 includes the words "zero" through "nine."

After programming the current clock time, the AM and PM annunciators 43 and 45 are alternatively flashed as a means of prompting the user to provide a verbal input of "AM" or "PM." The time-of-day recognition word set 31 preferably includes the words "AM," "PM," and "NONE" as validation words. It is noted that the word "NONE" is appropriate when programming the current time in accordance with a military format. It is further noted that the tens-of-hours word set 23 includes the word "two" for military timekeeping purposes as well. After programming the current time and time-of-day, a confirmatory message such as "The Current Time is 12:30 P.M." is preferably broadcast over the speaker 34. It is noted that a user may exit the time programming procedure while saving any changes at any time preferably by depressing the TIME switch 78 once or initiating an appropriate verbal command such as "Save."

In addition to the clock and alarm features discussed with respect to the embodiment illustrated in FIG. 1, various other features may be provided for enhancing the functionality of a programmable clock 20 having a novel voice recognition interface. As shown in the embodiment depicted in FIG. 2, the programmable clock 20 preferably includes calendar and time zone functions and display characters. For example, the interface display panel 24 may include several time zone annunciators, such as PACIFIC, CENTRAL, and EASTERN annunciators 62, 64, and 66. In one embodiment, programming the current time includes the additional step of associating the current time with a particular time zone. After setting the current clock time, for example, the TIME ZONE annunciator 82 is preferably illuminated concurrently with the sequential flashing of the PACIFIC, CENTRAL, and EASTERN annunciators 62, 64, and 66. Alternatively, one or all of the time zone annunciators may be illuminated to a constant illumination state. After successfully validating a user's verbal input against a time zone word recognition word set, the selected time zone annunciator is preferably energized to an illuminated state while the other time zone annunciators are de-energized.

An advantage of including a time zone designation associated with the current clock time involves the convenience of displaying the current clock time in accordance with any one of a number of time zones. More particularly, double tapping the time zone switch 80 preferably results in illuminating the TIME ZONE annunciator 82 and flashing of the PACIFIC, CENTRAL, and EASTERN annunciators 62, 64, and 66. The current clock time may be displayed in any of the three time zones shown in FIG. 2 simply by verbally inputting the desired time zone. Upon validation of the user's verbal input, the selected time zone annunciator is illuminated and the current clock time is adjusted and displayed in accordance with the selected time zone.

Referring now to the embodiment illustrated in FIG. 3, the interface display panel 24 may include additional informational display elements for displaying daily calendar and multiple alarm information. Additionally, the programmable clock 20 may incorporate an audio message recording and playback capability for recording personalized alarm messages and for recording and playing back personal messages. A user preferably programs one of a number of alarms preferably by double tapping the alarm switch 74, which results in the illumination of the ALARM SET annunciator 101. As shown in FIG. 3, nine individual alarms may be programmed. An alarm number display 106 preferably provides status information as to the status of each of the programmable alarms.

When programming an alarm, for example, the currently unprogrammed alarms defined on the alarm number display 106 preferably flash, while currently programmed alarms remain illuminated. A user preferably programs an unprogrammed alarm by verbally inputting the number associated with one of the flashing alarm numbers. Upon validation of the verbal input against an alarm number recognition word set, the selected alarm number transitions to an illuminated state while all other alarm numbers are de-energized. The user is then prompted to program the activation time, date, alarm sound or any message associated with the selected alarm. The alarm time is preferably programmed in a manner substantially similar to that previously described hereinabove.

In addition, a user may specify a date, day, or all days for alarm actuation by appropriately responding to the visual prompts provided on the interface display panel 24. For example, after programming the alarm time, the day annunciator array 88 is preferably illuminated or, alternatively, transitioned to a flashing state to prompt a user to verbally input the desired day or days of the week on which the alarm is to be activated at the prescribed time. A day recognition word set preferably includes the word "all" in addition to each day of the week in order to allow the user to program the alarm for activation on each day of the week.

An alarm may also be programmed for execution on a particular month, day, and year. In this case, the MONTH annunciator 68 is preferably illuminated concurrently with the flashing of the tens-of-hours and hours display characters 45 and 47. A month recognition word set preferably permits a user to verbally input a valid month using the month's numerical designation which is displayed and illuminated in the tens-of-hours and hours character displays 45 and 47. Subsequently, the day of the selected month is preferably programmed by the user in response to the flashing tens-of-minutes and minutes display characters 49 and 51. After validation and confirmation of the month and day input information, the year annunciator 72 is preferably illuminated and the user preferably programs each numerical character of the four digit year designation by programming each of the tens-of-hours, hours, tens-of-minutes, and minutes display characters 45, 47, 49, and 51, respectively. Upon completing the programming of a first selected alarm number, a user may program additional alarms as desired.

In one embodiment, user interaction with the novel voice recognition interface is enhanced by permitting the user to advance through a programming procedure and exit a procedure at any time while saving any changes. For example, a user may wish to modify a particular parameter associated with the time or date of a pre-programmed alarm while leaving other parameters unchanged. As discussed previously, double tapping the alarm switch 74 preferably results in illuminating the ALARM SET annunciator 101 and flashing of unprogrammed alarm numbers while illuminating programmed alarm numbers. A verbal selection of a programmed alarm number preferably results in displaying the currently programmed time, date, and other information associated with the alarm. For example, after validating and confirming the user's verbal input representative of a selected program alarm number, the previously programmed alarm time is displayed on the alarm display 30. Initially, the tens-of-hours display character 45 is transitioned to a flashing state giving the user an opportunity to either modify the flashing display character information or advance to the next display character. Advancing through each of the alarm time display characters is preferably accomplished by single depression of the alarm switch 74.

The user, for example, may wish to modify the tens-of-minutes display character 49 while leaving all other display characters unchanged. In response to the flashing tens-of-hours display character 45, the user preferably single taps the alarm switch 74 resulting in constant illumination of the tens-of-hours display character 45 and flashing of the hours display character 47. The user advances past the flashing hours display character 47 by again tapping the alarm switch 74 a single time, thereby transitioning the hours display character 47 from a flashing state to a constant illumination state and transitioning the tens-of-minutes display character 49 to a flashing state. At this point, a user preferably verbally inputs a tens-of-minutes parameter which, after validation and confirmation, is displayed in the tens-of-minutes character display 49 at a constant illumination state. It is to be understood that other time, date, alarm, and related information can be modified in a similar manner. In order to save any changes and exit the alarm programming mode, the user need only double tap the alarm switch 74.

As is further illustrated in the embodiment shown in FIG. 3, the interface display panel 24 includes a message annunciator 92, message counter display 94, and various message playback and recording annunciators. In accordance with this embodiment, the programmable clock 20 includes a playback and record capability which allows a user to record, playback, delete, and progress through a plurality of personal messages. A command switch 108 is preferably double tapped by the user to invoke the record and playback capability of the programmable clock 20. Alternatively, a verbal command associated with a particular record or playback function may be issued to execute the desired function. The PLAY, DELETE, RECORD, and START annunciators 96, 98, 100, and 102 are preferably transitioned to a flashing state concurrently with the illumination of the MESSAGES annunciator 92 upon double tapping the command switch 108 or issuing an appropriate verbal command. A user can verbally initiate recording of a new message, for example, by inputting the word "RECORD" which, after validation of the verbal input, allows the user to record a personal message, alarm, or prompt.

Figure 5:
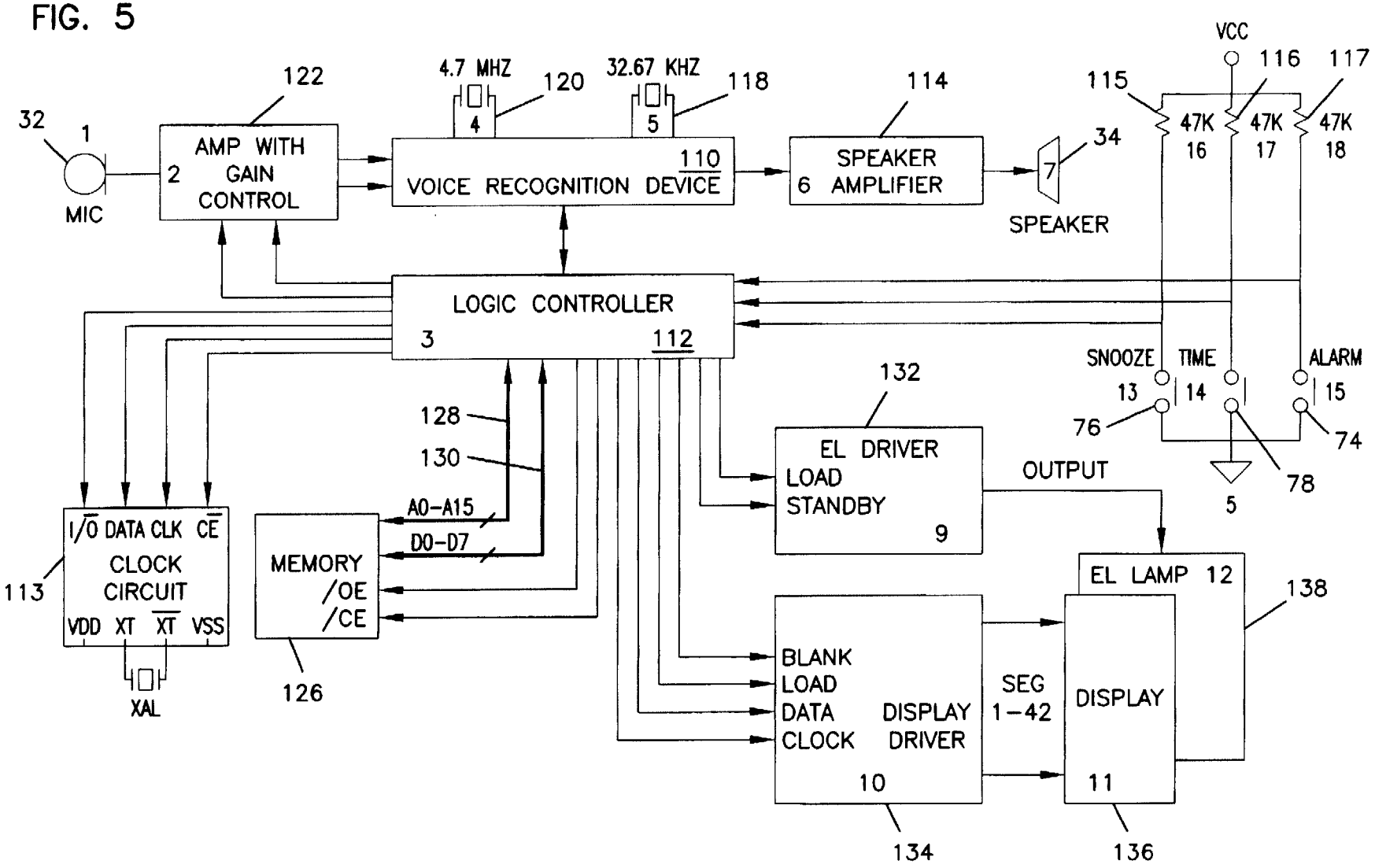
FIG. 5 is a schematic illustration of various electronic components of a novel voice recognition interface and a programmable timekeeping device.

Turning now to FIG. 5, there is illustrated a system block diagram of one embodiment of a novel voice recognition interface adapted for use with a programmable clock 20. In accordance with this embodiment, a voice recognition integrated device 110 is preferably employed to provide full voice recognition when interfacing with a programmable clock 20. The compact form factor or packaging configuration of the voice recognition integrated device 110 and other components illustrated in FIG. 5, together with relatively low power requirements, advantageously provides for the incorporation of the voice recognition interface and programmable timekeeping device in a wide variety of applications, including incorporation into a watch, small travel alarm clock, full-size clock for the home, office, or hotel, and for use in other stand-alone or embedded applications. Exploiting the functional, power, and size advantages of the voice recognition integrated device 110 in combination with unique logic control and programming provides for a sophisticated voice recognition interface that can be manufactured efficiently and at a relatively low cost.

As illustrated in FIG. 5, a logic controller 112 communicates with other components of the voice recognition interface to effectuate the programming and querying operations of the programmable clock 20. The logic controller 112 preferably executes a set of programmed instructions that coordinate the management of information exchanged between a memory 126 and a voice recognition device 110. The logic controller 112 further coordinates displaying of visual prompts by controlling a display driver 134 coupled to a display 136, and broadcasting of verbal prompts and messages broadcasted over a speaker 34. Verbal information communicated between the programmable clock 20 and a user is facilitated by a microphone 32 and the speaker 34 coupled to the voice recognition device 110. A pre-amplifier 122 is preferably coupled to the microphone 32, and includes automatic gain control to ensure high quality voice reception at varying distances from the programmable clock 20. A speaker amplifier 114 is preferably coupled to the voice recognition device 110 for driving the speaker 34, which is preferably an eight Ohm speaker. A suitable pre-amplifier 122 is model LM 324 manufactured by National Semiconductor, and a suitable speaker amplifier 114 is SMC 1157 manufactured by OKI Semiconductor.

The logic controller 112 is preferably coupled to a plurality of mode selection switches which permit a user to manually select any one of a plurality of interface and clock modes. In the embodiment shown in FIG. 1, for example, the three mode selection switches disposed on the base 26 include a snooze switch 76, a time switch 78, and an alarm switch 74. The mode selection switches may be of a single mode type or a multi-mode type, such as the dual mode selection switches 74, 76, and 78 discussed previously with respect to FIG. 1. Current limiting resistors 115, 116, and 117 are respectively coupled between the mode selection switches 76, 78, and 74 and a voltage source (VCC). The time base for the system is preferably provided by a 4.7 MHz crystal 120, while transactions involving the memory 126 and voice recognition device 110 are preferably managed by the controller 112 using a low frequency crystal 118 of approximately 32 KHz. It is to be understood that the disclosed clock speeds can be increased for faster performance or decrease as desired.

The controller 112 additionally coordinates the information displayed to the user over the display 136. Time, alarm, snooze, and other data are preferably transmitted to the display driver 134 from the controller 112 when a user interacts with the voice recognition interface, and when displaying clock information and conveying other visual information to the user. In one embodiment, a liquid crystal display (LCD) 136 is preferably coupled to an LCD driver 134. A suitable LCD driver is the 84-dot LCD Driver model SN6544 manufactured by OKI Semiconductor. The controller 112 also preferably drives an electro-luminescent driver 132 which controls an electro-luminescent lamp 138 to provide back-lighting for the display 136. The controller 112 preferably activates the electro-luminescent lamp 136 when any verbal or switch function is actuated by a user.

As is further illustrated in FIG. 5, a logic controller 112 cooperates with a voice recognition device 110 to coordinate receiving, processing, and broadcasting of verbal inputs and prompts communicated between a user and the novel voice recognition interface for the programmable clock 20. The logic controller 112 preferably executes microcode or software for implementing a predetermined sequence of processing steps in accordance with a user-selected programming or query operation. It is noted that the microcode or software executed by the controller 112 may be stored in a Read-Only-Memory (ROM) internal to the controller 112, or, alternatively, in an external memory, such as the memory 126. The logic controller 112 is coupled to the memory 126 within which is stored a plurality of digital word libraries that contain various word sets. The logic controller 112 coordinates the transfer of specific validation word sets between the memory 126 and the voice recognition device 110 when validating a verbal input from a user received by the microphone 32, as is discussed in greater detail hereinbelow with respect to FIG. 6.

The logic controller 112 is also coupled to a display driver 134 which controls a display 136. The display 136 preferably includes a plurality of display segments which are arranged to facilitate the display of various alphabetic and numerical parameters in a manner illustrated on the display interface panel 24 of the programmable clock 20 illustrated in FIG. 1. An electro-luminescent driver 132, which is coupled to the logic controller 112, preferably drives an electro-luminescent lamp 138 which provides back-lighting for the display 136. The LCD driver 134 preferably drives the various annunciators, such as the RESPONSE and ALARM annunciators 40 and 54, to provide the requisite illumination and flashing capability. A clock circuit 113 is preferably coupled to the logic controller 112 to provide clock time and alarm time inputs which are displayed on the display 136. The clock circuit 113 is preferably a discrete IC that provides clock time and alarm time information associated with the programmable clock 20. Verbal prompts, phrases, and messages are preferably produced at an output of the voice recognition device 110, which are amplified by the speaker amplifier 114 and broadcasted to a user over a speaker 34. Various control switches, such as the alarm switch 74, snooze switch 76, time switch 78, and command switch 108 are preferably coupled to the logic controller 112 to provide for manual interaction with the programmable clock operation. As discussed previously, the control switches 74, 76, 78, and 108 are preferably dual-mode switches which perform multiple functions depending on whether the switch is single or double depressed.

An important feature of the novel voice recognition interface concerns the control functions performed by the logic controller 112 when coordinating the transfer of word sets, pre-synthesized phrases, and other verbal prompts between the memory 126 and the voice recognition device 110. Another important feature involves the execution of a series of pre-programmed operations by the logic controller 112, including visually and verbally prompting a user for a specific verbal input or set of inputs, validating the verbal inputs against pre-established word sets, confirming the validity or invalidity of the verbal inputs either visually or verbally, and operations to effect programming of various time, alarm, and date parameters into the programmable clock 20.

Figure 6:
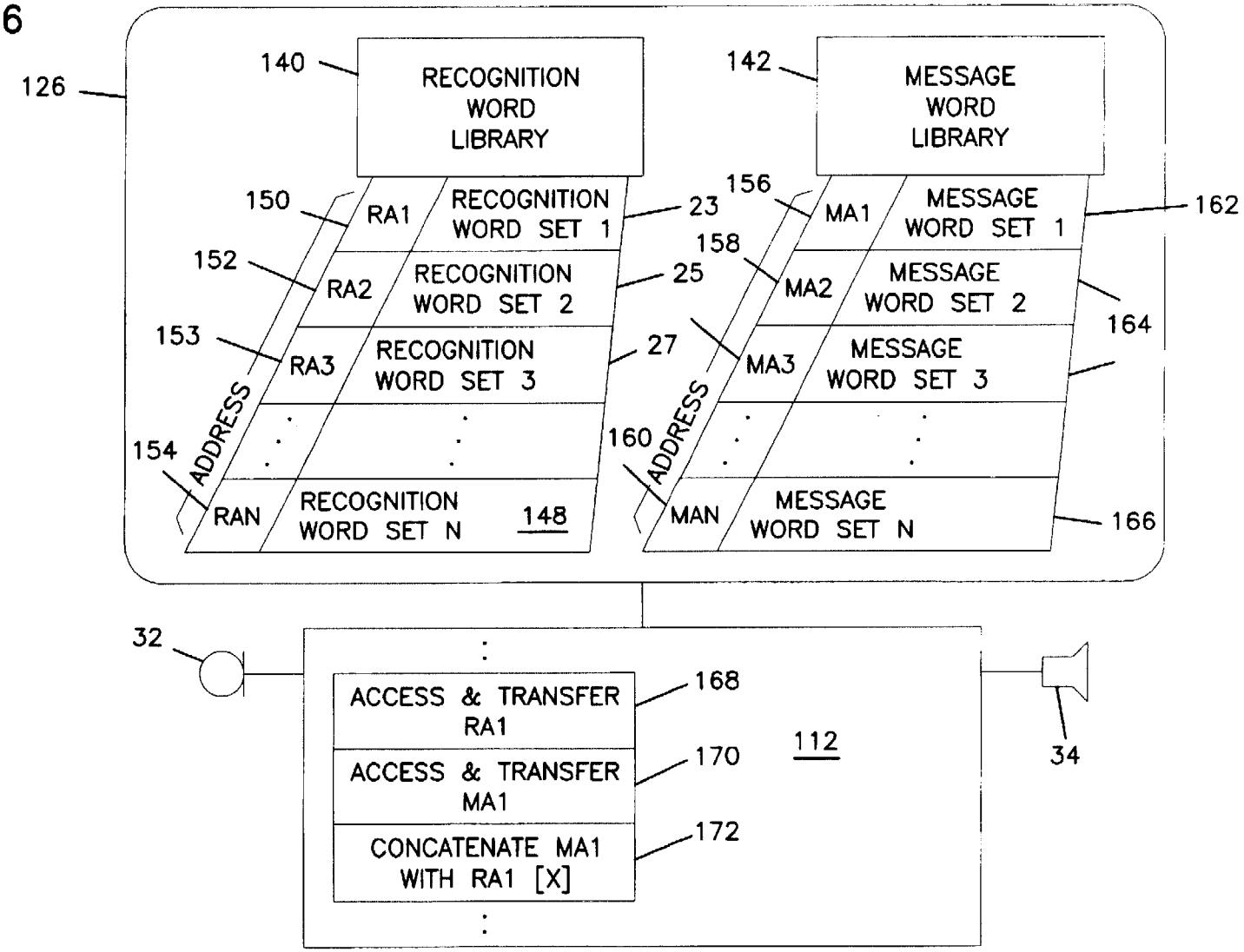
FIG. 6 is a depiction of a logic controller operatively coupled to a memory configured to store a recognition word library and a message word library.
Figure 7:
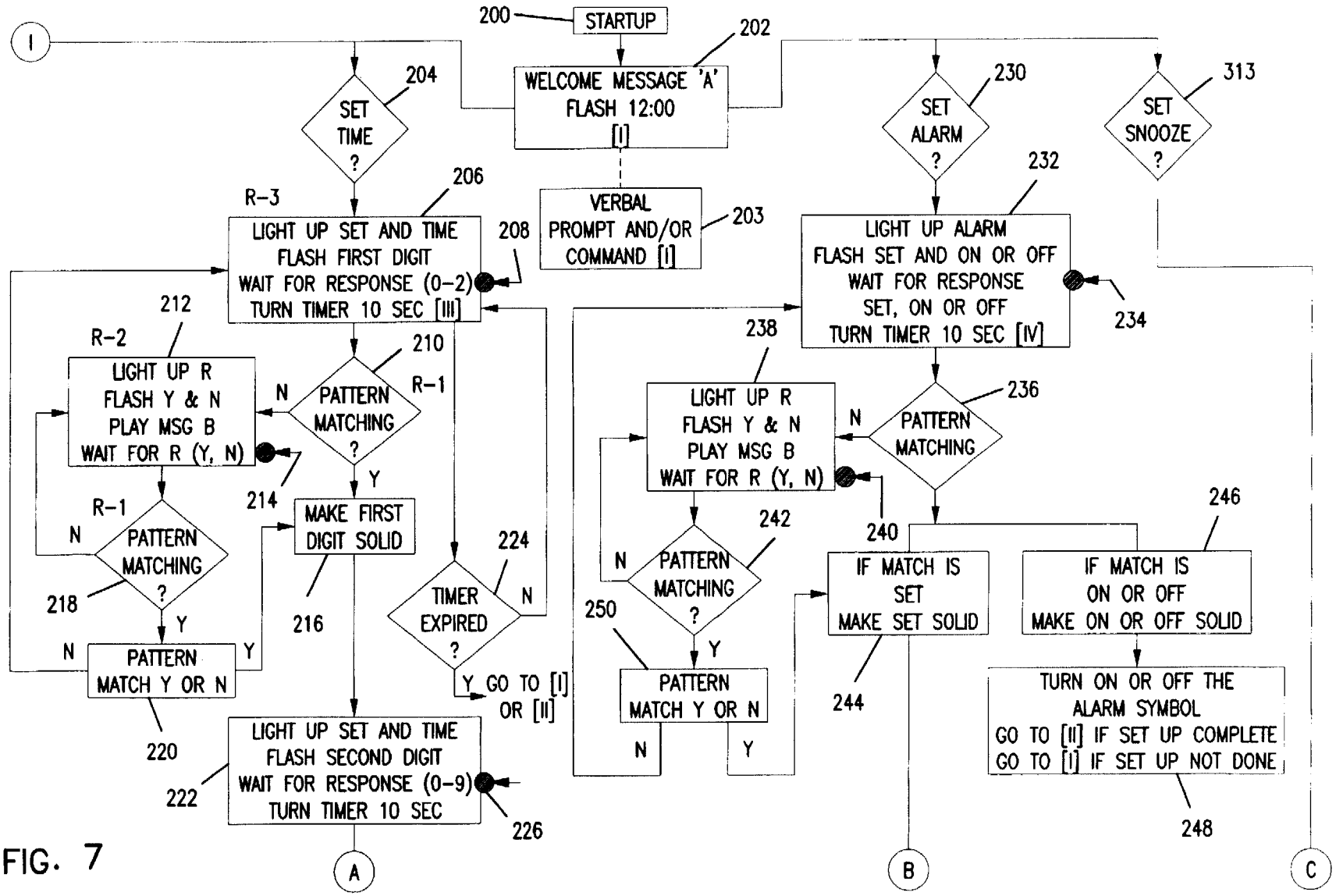
FIGS. 7–11 are illustrative logic flow diagrams describing various process steps for programming, querying, and interacting with a programmable timekeeping device employing a novel voice recognition interface.

In one embodiment, as depicted in FIG. 6, a recognition word library 140 and a message word library 142 are preferably defined and stored in the memory 126. The recognition word library 140 preferably includes a number of recognition word sets stored at a corresponding number of recognition word set addresses in the memory 126. Similarly, the message word library 142 preferably includes a number of message word sets accessible to the logic controller 112 by referencing a corresponding number of message word set addresses in the memory 126. It is noted that a direct, indirect, or other addressing scheme may be implemented when establishing and accessing the recognition and message word sets maintained in the memory 126.

The logic controller 112 electrically communicates with the memory 126 by producing address signals which are transmitted to the memory 126 over a plurality of address lines 128. The appropriate word set data, pre-synthesized phrases, and other verbal prompt data are preferably communicated between the logic controller 112 and the memory 126 over a plurality of data lines 130. Further, the logic controller 112 coordinates the multiplexing or interleaving of recognition word set data with message word set data when executing various operations, such as when confirming the accuracy of a verbal input from a user by broadcasting a confirmatory message constructed from words retrieved from both of the recognition and message word libraries 140 and 142.

For purposes of explanation, and not of limitation, a further discussion of the embodiment illustrated in FIG. 6 is provided by reference to the clock time programming steps illustrated in FIG. 4. The recognition word library 140, for example, preferably includes a number of distinct recognition word sets including a tens-of-hours recognition word set 23, an hours recognition word set 25, a tens-of-minutes recognition word set 25, a minutes recognition word set 29, and a time-of-day recognition word set 31. Other word sets containing a specified number of validation words are preferably provided for other functions, such as setting a snooze duration associated with one or more programmable alarms. It is assumed for purposes of this example, that the tens-of-hours recognition word set 23 is accessible to the logic controller 112 by reference to the recognition word library memory address RA1 150, that the hours recognition word set 25 is accessible by reference to the memory address RA2 152, and that the tens-of-minutes recognition word set 27 is accessible by reference to the memory address RA3 153. It is noted that other recognition word sets associated with other voice recognition interface operations are included in the recognition word library 140 and are each accessible by referencing a unique address corresponding to each recognition word set.

It is further assumed that the pre-synthesized confirmatory message word set "Did You Say . . ." 162 is stored in the message word library 142 and is accessible to the logic controller 112 by referencing the message word library memory address MA1 156. Additionally, it is assumed that the message word set "Alarm is Set On/Off for . . ." 164 is accessible by reference to message word library memory address MA2 158. As discussed previously, programming the clock time is preferably initiated by actuation of the time switch 78 or by issuing a verbal instruction to initiate the clock time programming procedure. A verbal instruction such as "COMMAND SET TIME," for example, may be issued to initiate the clock time programming process.

The process of programming the clock time preferably begins by flashing the tens-of-hours display character 46 as a visual prompt to the user to verbally input a desired tens-of-hours time parameter. Concurrently, the logic controller 112 accesses the tens-of-hours recognition word set 23 stored at recognition word library memory address RA1 150, and transfers the accessed recognition word set 23 data to the voice recognition device 110. It is noted that the tens-of-hours recognition word set 23 includes the words "zero," "one," and "two." Upon responding to the flashing tens-of-hours display character 46 prompt, a user's verbal time parameter input is preferably received by the microphone 32 and transmitted to the voice recognition device 110. An amplifier 122, preferably employing automatic gain control, amplifies and conditions the user's verbal input received from the microphone 32.

The verbal input received by the microphone 32 is preferably converted from an analog signal to a digital signal by the voice recognition device 110 or, alternatively, by an analog-to-digital converter (not shown) disposed between the microphone 32 and the voice recognition device 110. The logic controller 112 preferably produces an instruction to cause the voice recognition device 110 to compare the user's digitized verbal input to the tens-of-hours recognition word set 23 for purposes of validating the verbal input. Upon a successful comparison between the user's verbal input and one of the recognition words defined in the tens-of-hours recognition word set 23, the voice recognition device 110 preferably produces a match signal which is transmitted to the logic controller 112.

In response to the match signal, the logic controller 112 accesses the message word library memory address MA1 156 containing the pre-synthesized confirming word set "Did You Say . . ." 162. The logic controller 112 instructs the voice recognition device 110 to concatenate the message word set "Did You Say . . . " 162 with the matching word of the tens-of-hours recognition word set 23. For example, it is assumed that the user verbally inputs the word "One" in response to the flashing tens-of-hours display character 46 prompt, thus resulting in a successful matching condition and the production of a match signal by the voice recognition device 110. In response to the match signal, the logic controller 112 instructs the voice recognition device 110 to perform the concatenation of the message word set "Did You Say . . . " 162 with the recognition word "One," and further instructs the voice recognition device 110 to broadcast the verbal output of "Did You Say One?" over the speaker 34.

The logic controller 112 then instructs the display driver 134 to illuminate the RESPONSE, YES, and NO annunciators 40, 42, and 44, and further instructs the memory 126 to transfer the "YES, NO" response recognition word set 33 to the voice recognition device 110. The illuminated annunciators prompt the user to reply with a YES or NO response. The user's verbal input is received by the microphone 32 and transferred to the voice recognition device 110 where a comparison is made between the verbal input and the response recognition word set 33. The logic controller 112, in response to a match signal produced by the voice recognition device 110, instructs the display driver 134 to display a numerical "1" in the character display 46, thus transitioning the display character 46 from a flashing state to a constant illumination state in which the numeral "1" is displayed.

An unsuccessful comparison between a user's verbal input and the validation words defining a recognition word set results in the production of a no-match signal produced by the voice recognition device 110. In response to a no-match signal, the logic controller 112 preferably coordinates the transfer of an input error message word set, such as "Invalid Entry," from the message word library 142 to the voice recognition device 110 for subsequent broadcasting over the speaker 34. In one embodiment, the applicable display character is again flashed as a visual prompt to the user to input an appropriate verbal time parameter, and the validation process discussed above is preferably repeated. In an alternative embodiment, it may be desirable to verbally instruct a user as to the permissible or valid verbal inputs corresponding to a particular programming step after having responded incorrectly to a particular display prompt.

For example, a no-match error condition resulting from an invalid verbal input for programming the tens-of-hours display character 23, such as the verbal input of the word "five," is preferably communicated to the user by a verbalized error phrase such as "Invalid Entry . . . Valid Entries are Zero through Two." The user may then respond to the verbal error message preferably by inputting an appropriate verbal response. After successfully programming the tens-of-hours display character 46, a user may program the hours, tens-of-minutes, and minutes display characters 48, 50, and 52 in a similar manner.

It can be seen that the logic controller 112 preferably coordinates memory access, transfer, and concatenation operations in accordance with predefined steps for facilitating orchestrated voice recognition interfacing with the programmable clock 20. As further shown in FIG. 6, the concatenation program steps performed by the logic controller 112 in the illustrative example discussed above include the steps of accessing the tens-of-hours recognition word set 23 at recognition word library memory address RA1 150, and transferring the recognition word set 23 ["zero," "one," and "two"] to the voice recognition device 110 at step 168. The logic controller 112, at step 170, accesses the confirmatory message word set 162 ["Did You Say . . . "] by referencing the message word library hmemory address MA1 156, and then transfers the confirmatory message word set 162 to the voice recognition device 110.

At step 172, the logic controller 112 then instructs the voice recognition device 110 to concatenate the message word set 23 |"Did You Say . . . "| with the validation word corresponding to the validated verbal input |"One"|, followed by an instruction to the voice recognition device 110 to broadcast the concatenated confirmatory message "Did You Say One?" over the speaker 34. Those skilled in the art will appreciate that a wide variety of functionality can be programmed into the novel voice recognition interface by appropriately defining various recognition word sets and message word sets, and performing appropriate access, transfer, and concatenation operations to provide an intuitive, voice-based interface for interacting with a programmable clock 20 or other digital timekeeping device.

Referring now to FIGS. 7–11, there is illustrated in flow diagram form various process steps for interacting with a programmable clock 20 employing a novel voice recognition interface. The logic controller 112 preferably executes various programming steps to effectuate the operations depicted in FIGS. 7–11. At various steps in the program flow, there is made reference to particular messages identified by alphabetic designators, such as MSG-A, and presynthesized words which correspond to the verbal phrases and words defined in FIG. 12. Further, there is made reference to one or more routines at various process steps which correspond to the routines described in FIG. 12. The indicated routines have been previously described in detail and therefore will only be discussed generally with respect to FIGS. 7–11.

As discussed previously, a user preferably interacts with the programmable clock 20 by use of verbal commands and inputs which are received, validated, interpreted, and executed by the novel voice recognition interface to effect various programming and querying operations. Initially, as indicated at steps 200 and 202, a user preferably initiates interaction with a programmable clock 20 by issuing a command word, such as the word "COMMAND," or, alternatively, by depressing any of the manually actuatable control switches disposed on the base 26 of the programmable clock 20. A welcoming message MSG-A 500 is preferably broadcast over the speaker 34. The welcoming message MSG-A 500 preferably provides information for verbally and manually interacting with the programmable clock 20. For example, an appropriate welcoming message would be "Welcome to the Voice-It Programmable Clock. Double Tap the Time, Alarm, or Snooze Switch to Enter the Set-Up Mode, or say 'COMMAND SET UP' to Initiate verbal Interaction with the Voice-It Programmable Clock."

Among the various interactive operations made available upon initial interaction with the voice recognition interface, a user may, for example, set the clock time at step 204, set one or more alarms at step 230, set a snooze duration for one or more alarms at step 313, record personal messages at step 340, perform various query operations at step 360, set personalized verbal prompts at step 400, establish calendar information at step 440, and set time zone information at step 460. It is to be understood that other operations and functionality may be provided by including additional programming steps to be performed by the logic controller 112, and that the various programming steps and interactive operations performed by the novel voice recognition interface and programmable clock 20 as described herein are for purposes of illustration only, and not of limitation.

A user may program the clock time 204 preferably by verbalizing a set time command, such as "COMMAND SET TIME," or by double depressing the time control switch 78. As discussed in detail hereinabove, the SET and TIME annunciators 36 and 38 are preferably illuminated, and the first digit of the time display is preferably flashed at step 206. Concurrently, a countdown timer is preferably activated which will count down a predefined number of seconds, such as ten seconds, while the voice recognition interface waits for a verbal input from the user. If the countdown timer expires prior to receiving a verbal input, the logic controller 112 terminates the set time operation and returns to a previous mode of operation. It is noted that a time-out message such as "No Response Received, Returning to Normal Operation" may be broadcast over the speaker 34 in response to the expiration of the countdown timer. It is further noted that some or all of the activities associated with step 206 are referred to as Routine 3 (R-3).

With further reference to step 206, the logic controller 112 preferably enables the microphone 32, and instructs the voice recognition device 110 to transition to a recording mode. In response to a verbal input from the user at step 208, the verbal input is converted from its original analog form to a digital form and preferably compressed in accordance with a known compression algorithm by the voice recognition device 110 or other audio compression device disposed between the microphone and the voice recognition device 110. The logic controller 112 instructs the voice recognition device 110 to store the bit pattern corresponding to the user's verbal input at a storage location within or accessible to the voice recognition device 110. Also, the recognition word set associated with all valid responses applicable to programming the first digit of the time display 28 is transferred from the memory 126 to a storage location within or accessible to the voice recognition device 110. At step 210, the logic controller 112 instructs the voice recognition device 110 to perform a bit pattern comparison of the user's verbal input with the validation words defined in the corresponding recognition word set.

An important feature of the novel voice recognition interface concerns a speech recognition capability that provides for highly reliable user-independent recognition of any number of words and phrases. The voice recognition interface also provides for highly reliable user-dependent recognition of any number of words and phrases uttered by a single user, which is particularly useful when limiting access to sensitive information or programming routines, for example. It is to be understood that no laborious training of the voice recognition interface is necessary, which is required by prior art voice recognition devices, such as the Voice Activated Personal Organizer apparatus discussed previously in the Background of the Invention.

In one embodiment, the synthesized phrases, messages, and prompts maintained in the memory 126 are stored therein as digital signature pattern data corresponding to composite voice data produced by synthesizing the speech patterns acquired from a plurality of human sources. As such, dialect, tonal, and other frequency and amplitude variations inherent in human speech patterns are effectively averaged to produce a composite signature pattern corresponding to each validation word. This averaging process provides for highly reliable recognition of words and phrases without regard to variations in an individual's unique speech characteristics.

Additionally, the voice recognition device 110 is also preferably capable of providing user-specific voice recognition for security purposes, and preferably responds only to the speech characteristics of a particular user. It may be desirable, for example, to limit access to various functions, such as recording and retrieving personal messages, exclusively to a particular user. In such cases, the user's unique voice signature pattern for particular words and phrases may be stored in the memory 126 and compared to an instant user's verbal input when attempting to perform certain functions or attempting to obtain sensitive information. Access to such information and functions will be denied to all but the user whose voice signature patterns are stored in various security recognition word sets stored in the memory 126 for purposes of enhancing security. A suitable voice recognition device 110 for performing these and other functions is model RSC-164 or RSC-264 manufactured by Sensory Circuits, Inc.

In response to a successful match between the user's verbal input and a word defined within the associated recognition word set, the first digit of the time display is illuminated at a constant illumination state as indicated at step 216. In response to an unsuccessful pattern match, the RESPONSE annunciator 40 is illuminated, and the YES and NO annunciators 42 and 44 are flashed at step 212. It is noted that the activities associated with step 212 are referred to as Routine 2 (R-2). Additionally, a confirmatory message, such as "Did You Say . . ." is preferably transferred from the message word library 142 residing in the memory 126 to the voice recognition device 110. The logic controller 112 preferably instructs the voice recognition 110 to concatenate the confirmatory message word set with the estimated or actual verbal input that resulted in the no-match condition at step 210 to construct a multiplexed confirmatory message MSG-B 502 that is broadcasted over the speaker 34.

A countdown timer is preferably initiated while the voice recognition interfaces waits for a response of YES or NO from the user at step 214. At step 218, the logic controller 112 transfers a response recognition word set 33 [YES, NO] to the voice recognition device 110 which is then compared to a verbal response input received from the microphone 32 at step 212. Upon a successful match between the verbal input and either the YES or NO signature pattern, the logic controller 112 illuminates the first digit in the time display at a constant illumination state at step 216. An unsuccessful match at steps 218 and 220 results in the initiation of the program steps previously discussed with respect to steps 212 and 206, respectively. The user preferably programs the second, third, and fourth digits 48, 50, and 52 of the time display 28 in a similar manner beginning at steps 222 and 252.

Figure 8:
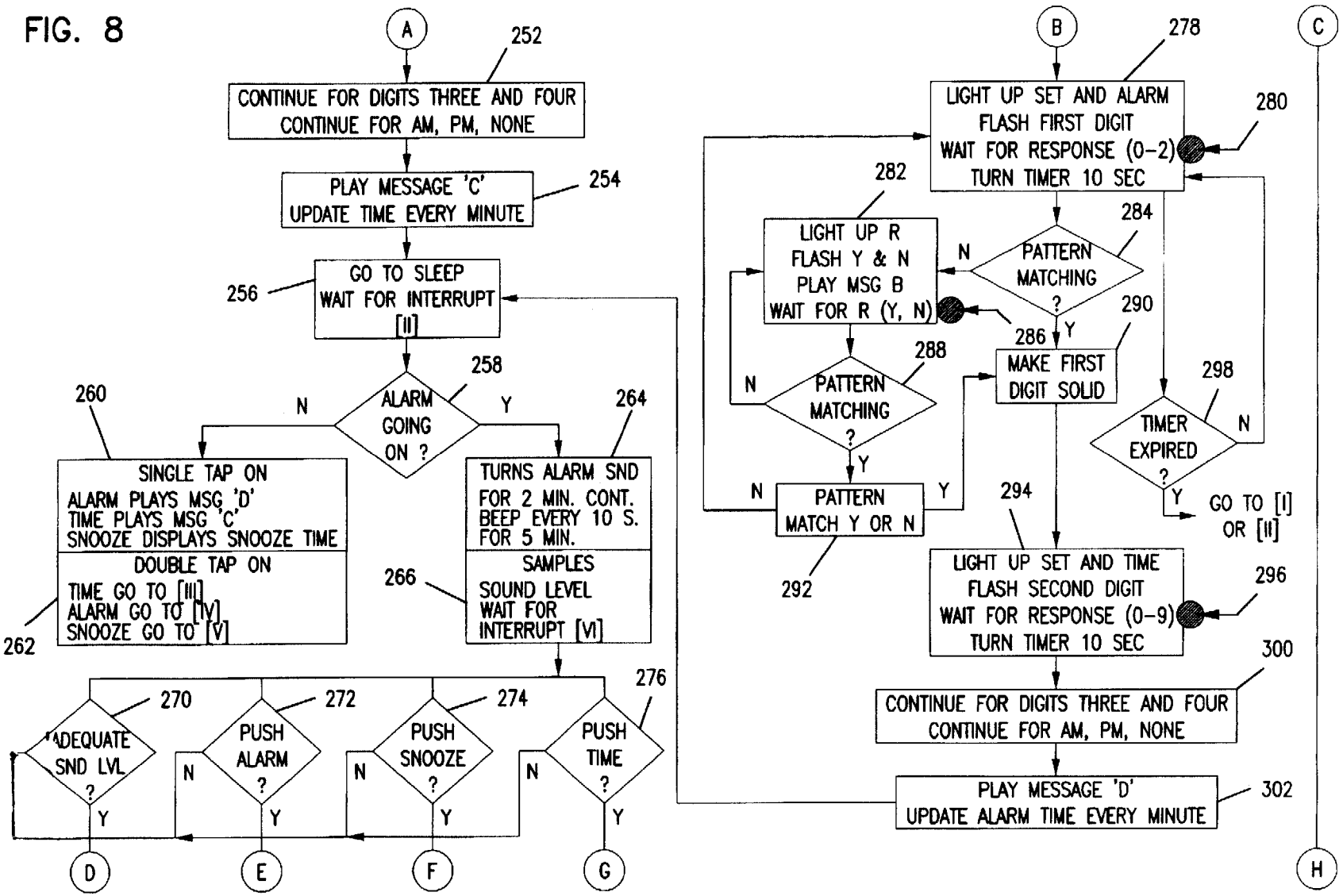

Upon completing step 252, as depicted in FIG. 8, all four of the display characters 46, 48, 50, and 52 of the time display 28 have been programmed by the user, as well as the time-of-day indication of AM, PM, or NONE. A confirmatory message MSG-C 504, which verbally reiterates the programmed clock time, is preferably broadcasted at step 254. As is also indicated at step 254, the time display 28 is preferably updated and refreshed every minute. In the absence of further user interaction with the programmable clock 20, the system continues normal operation, typically by continuous displaying and updating of the clock time, until such time as the logic controller 112 receives either an automatic or user-generated instruction, as indicated at step 256. It is noted that the process of programming alarm and snooze parameters, respectively initiated at steps 230 and 313, is accomplished in a manner substantially similar to that discussed above with regard to programming clock time parameters.

The activation of an alarm at step 258 preferably results in broadcasting an alarm sound, beep, or verbal message at step 264. In one embodiment, a predefined verbal alarm message is preferably transferred from the memory 126 to the voice recognition device 110 and broadcasted over the speaker 34 in response to activation of an associated alarm at a predefined alarm activation time. Alternatively, music, a beep, or other alarm sound can be broadcasted continuously or intermittently for a predefined time period, such as five minutes. Additionally, at step 266, the broadcast sound level is preferably monitored or sampled as an input to the microphone 32 and voice recognition device 110. This information may be processed for purposes of modifying the sound level in response to a verbal or manually actuated switch command, as indicated at step 270.

Figure 9:
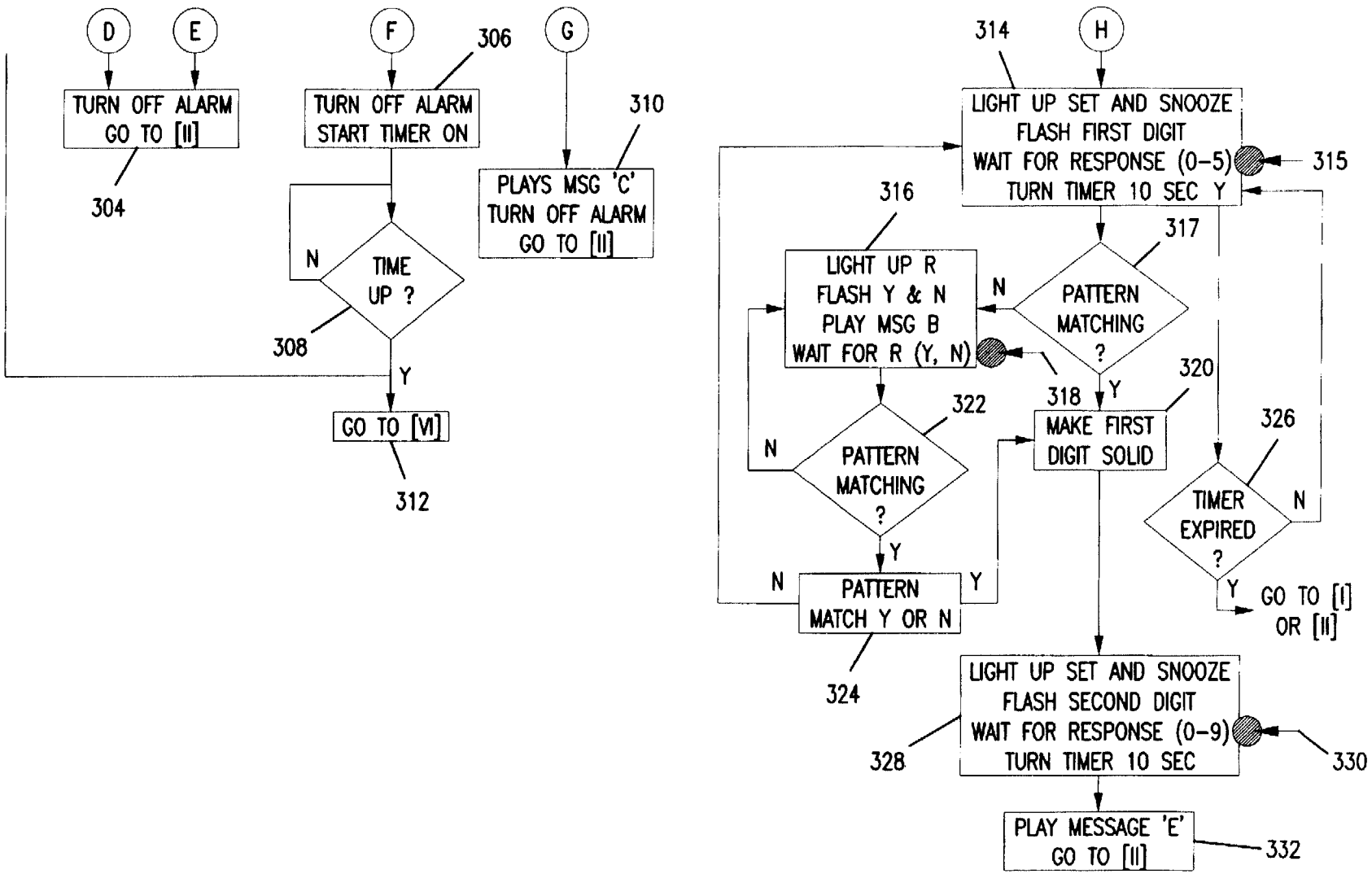

As further depicted in FIGS. 8 and 9, the logic controller 112 preferably monitors the activity of various control switches at step 266, as well as the microphone 32, for purposes of permitting a user to respond to the audio alarm. Depressing the alarm control switch 74 at step 272, for example, preferably terminates the alarm and returns program control to step 256 in which the clock 20 continues with normal operation and awaits further interaction with the user. Depressing the snooze control switch 76 at step 274 preferably results in temporarily suspending the alarm broadcast and initiating a snooze timer. After expiration of a predefined snooze timer duration, as tested at step 308, the alarm is rebroadcasted and program flow preferably continues at step 258.

In response to depressing the time control switch 78 a single time at step 276, an alarm message word set is preferably transferred from the memory 126 to the voice recognition device 110 and concatenated with a word set corresponding to the currently programmed alarm time. An alarm message MSG-D 506, such as "Alarm is Turned On for Six Fifteen A.M." or "Alarm is Turned Off," may be broadcast to the user for purposes of conveying current alarm status information. Depressing the time control switch 78 during broadcasting of an alarm preferably results in terminating the alarm, as indicated at step 310, and returning program flow to step 256, thus continuing normal operation of the programmable clock 20.

Figure 11:
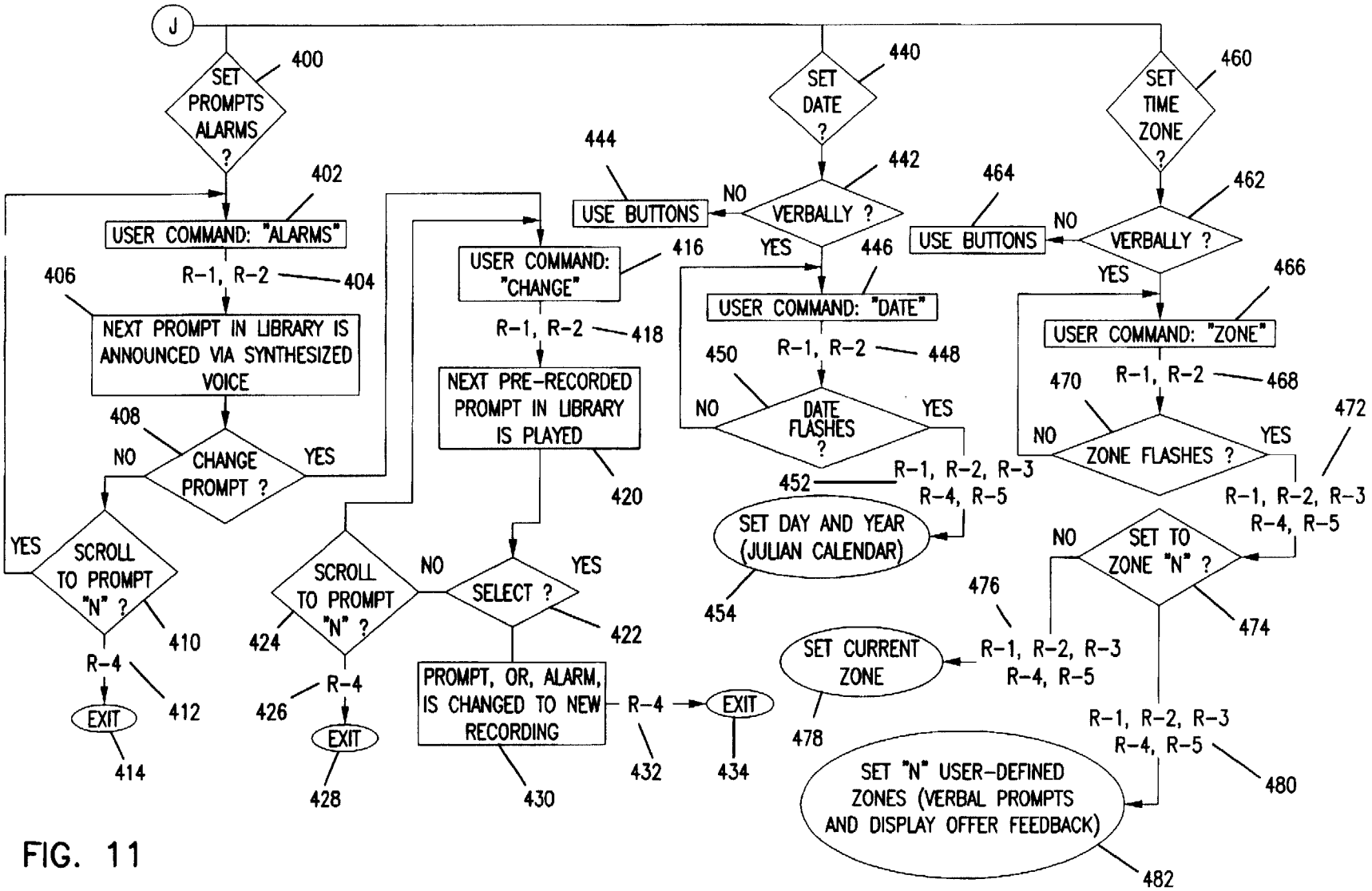

Referring now to FIG. 11, the user may set the current date of the programmable clock 20 at step 440. As with other interfacing operations, a user may verbally initiate the date setting operation by verbally inputting an appropriate command word, such as "COMMAND SET DATE" at step 446, or, alternatively, double depressing a date control switch (not shown) or other combination of control switches to initiate the date setting operation, as indicated at step 444. The display characters associated with displaying the current date are preferably transitioned to a flashing state at step 450, and verbal inputs corresponding to the desired date parameter are input, verified, and displayed at step 454 in a manner substantially similar to that previously discussed hereinabove with respect to other clock parameter programming operations. Preferably, a user may program the current date based on the Julian calendar or Gregorian calendar.

At step 460, time zone parameters may be established either by voice command at step 462 or by actuation of an appropriate control switch or combination of control switches as indicated at step 464. Upon initiating the time zone setting operation, the display characters or annunciators corresponding to selectable time zones are preferably transitioned to a flashing state at step 470. In the embodiment illustrated in FIG. 2, for example, each of the PACIFIC, CENTRAL, and EASTERN annunciators 62, 64, and 66 are preferably flashed at step 470. A user preferably verbalizes a desired time zone associated with the current display time at step 478, or alternatively, may define a different time zone at step 482 by responding to the appropriate verbal prompts and providing appropriate input information. As with other verbal input operations, a user's verbal time zone input is preferably validated and confirmed to ensure accuracy of the input information.

An important aspect of the novel voice recognition interface concerns the capability of personalizing or modifying the various verbal prompts and messages that facilitates intuitive and efficient navigation of the various command and programming operations and generally enhances user-interaction with the programmable clock 20. The following processing steps will be discussed in terms of modifying prompts, but it is understood that these steps are equally applicable to modifying messages, verbal alarms, and other responsive words and phrases. At step 400, a user preferably initiates the set prompts/messages procedure by verbalizing an appropriate command word, such as "COMMAND SET PROMPTS," or, alternatively, by actuating an appropriate control switch or combination of switches. At step 406, prompts are broadcasted over the speaker 34, and the user is provided the opportunity to scroll through the prompts at step 408. For example, the RESPONSE, YES, and NO annunciators 40, 42, and 44 are preferably illuminated to invoke either a YES or NO response from the user. Alternatively, as indicated at 416, a user command, such as "CHANGE PROMPT," is preferably issued to effectuate the user's desire to modify the pre-recorded response prompt.

The microphone 32 is then enabled and the logic controller 112 instructs the voice recognition device 110 to begin recording a new prompt to replace the previously stored pre-established prompt. After verifying the accuracy and desirability of the newly recorded prompt, the next pre-recorded prompt in the prompt message library is broadcasted at step 420. The user, at step 422, may bypass the next broadcasted prompt and, at step 424, scroll through other prompts rapidly, until a desired prompt is broadcasted. At step 430, the newly recorded prompt or alarm is stored in the prompt message library, and the previously pre-recorded prompt or alarm message is purged, overwritten, otherwise made inaccessible. It is to be understood that any prompt, alarm, or other verbal phrase which provides confirmatory feedback is generally definable and modifiable using this or other similar method.

Figure 10:
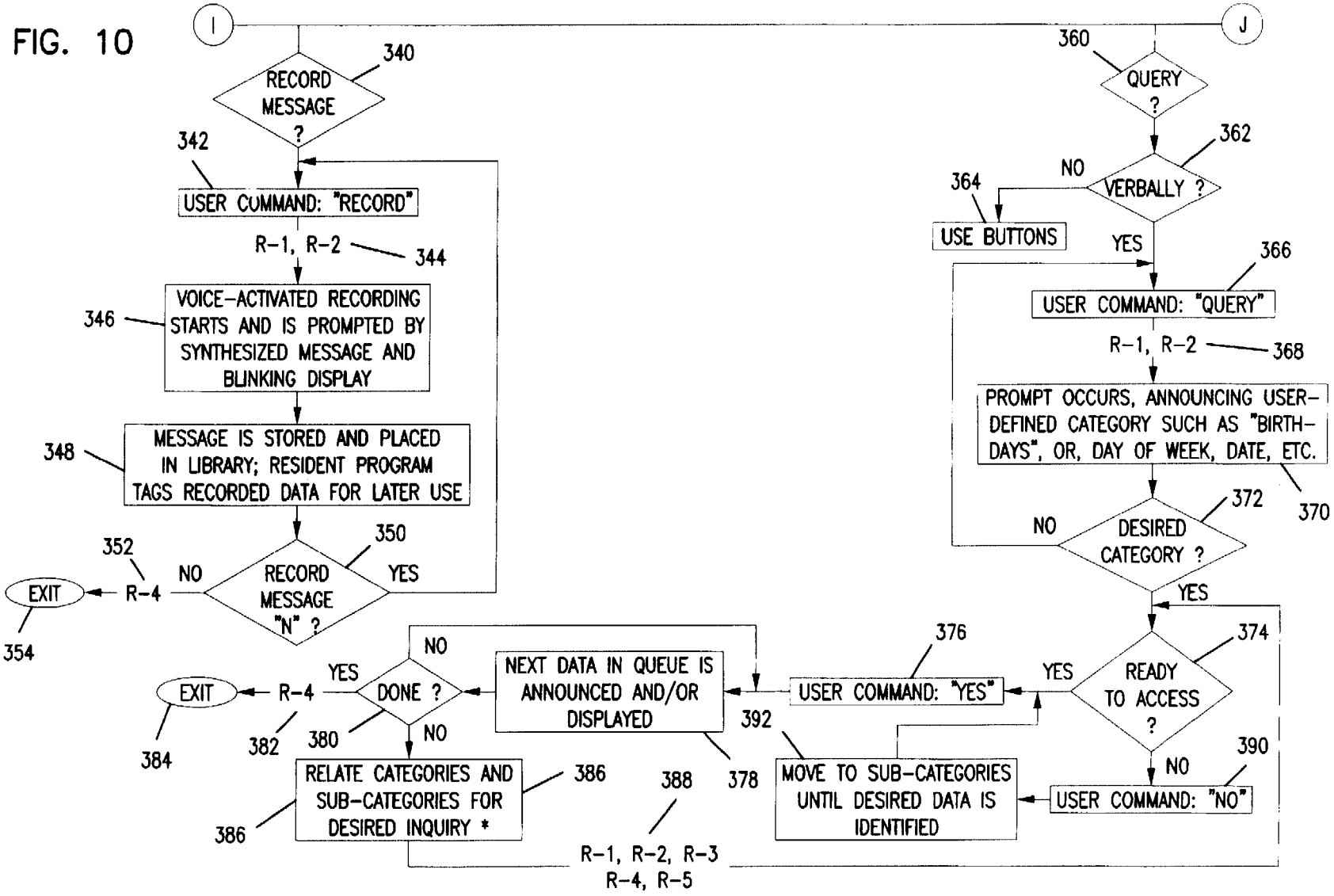

As depicted in FIG. 10, a user may record one or more personal messages as indicated at step 340. A verbal command, such as "COMMAND RECORD," or manual actuation of an appropriate control switch provided on either the base 26 or interface display panel 24 preferably activates the voice recognition device 110 and microphone 32 for recording a user's personal message. In one embodiment, as shown in FIG. 3, a user may record a number of discrete messages corresponding to the number of illuminatable message identification indicators 104 provided on the interface display panel 24. Alternatively, the number of recordable messages is limited only by the size of available memory 126, and not by the number of message identification indicators 104. The current number of stored messages in this case is preferably indicated by the message count display 94. The user actives a particular message indicator 104 preferably by verbalizing the desired message identification number corresponding to one of the flashing message indicators 104, as indicated at step 346.

A synthesized message retrieved from the message word library 142 preferably instructs the user to verbally or manually select a message identification number and prompts the user when to begin recording. In addition to selecting a desired message identification number, a message category may be established for relating particular messages and other information to specific user-defined message types. At step 346, for example, the voice recognition interface preferably requests whether the user desires to record a new message under a particular message category or whether the user desires to create a new message category. Should the user fail to recall the labels previously established for existing message categories, the logic controller 112 preferably coordinates communication of existing message category labels between the memory 126 and the voice recognition device 110 for broadcasting over the speaker 34. It is noted that the user may terminate the verbal review of message category labels at any time by issuing an appropriate verbal command, such as "End" or "End Review."

At step 348, the user's message is stored in the memory 126, and the logic controller 112 tags the recorded data for subsequent retrieval and manipulation. Any message category label or other information associated with the recorded message is also stored in the memory 126 for purposes of subsequent category-based accessing and searching. If desired, another personal message may be recorded, as indicated at the decision step 350. After recording a desired number of personal messages, the user, at step 354, may exit the record messages routine by responding with "No" when prompted by the illuminated RESPONSE annunciator 40 and flashing YES and NO annunciators 42 and 44 at step 350.

A user may perform a number of query operations in order to search for and play back desired personal messages and other information. At steps 360, 362, 364, and 366, a user initiates the query mode of operation by inputting an appropriate verbal command or by depressing the appropriate manually actuatable control switch. As indicated at steps 366, 370, and 372, specific message categories may be selected by issuing an appropriate verbal input, such as "Query Birthdays" or "Query Dates." After selecting a desired message category, the user is presented the opportunity to select any sub-category that may be defined under a main message category, as indicated at steps 374, 390, and 392. A message category such as "Birthdays," for example, may include a number of sub-categories such as "Relatives," "Clients," "Co-workers," and "Friends." Each of these sub-categories, in turn, may include further sub-category levels. The "Relatives" sub-category, for example, may include sub-categories such as "Mom," "Grandfather," "Julie," and other relatives.

When the desired message category and sub-category has been selected, as is confirmed at step 376, the associated message data or information is verbally broadcast over the speaker 34 and/or displayed on the interface display panel 24, as indicated at step 378. At step 380, a user may review multiple message entries and other informational data associated with a particular message category and sub-category. At step 386, a user may query other sub-categories defined under a higher-order sub-category or main category. A user performing a query of the category "Dates" and sub-category "Julian," for example, may branch to a "Day" sub-category in order to request and obtain which day of the week a particular date represents. Those skilled in the art will appreciate that any number of memory addressing schemes may be employed when tagging recorded and system-produced data in order to effectuate the recording and querying capabilities of the novel voice recognition interface for the programmable clock 20 discussed herein.

It will, of course, be understood that various modifications and additions can be made to the embodiments discussed hereinabove without departing from the scope or spirit of the present invention. Accordingly, the scope of the present invention should not be limited to the particular embodiments discussed above, but should be defined only by the claims set forth below and equivalents of the disclosed embodiments.

What is claimed is:

1. A voice recognition interface for a programmable timekeeping device including a display, a microphone, and a speaker, comprising:

prompting means for producing a prompt to invoke a verbal input from a user;

a memory for storing a plurality of message word sets and a plurality of recognition word sets;

a voice recognition device coupled to the microphone and the speaker; and a controller, comprising:

means for controlling the prompting means to produce the prompt;

means for transferring a recognition word set associated with the prompt between the memory and the voice recognition device;

means for coordinating displaying of a parameter corresponding to the verbal input on the display in response to the voice recognition device successfully comparing the verbal input with the recognition word set; and means for transferring to the voice recognition device for broadcasting over the speaker a message word set associated with the prompt in response to the voice recognition device unsuccessfully comparing the verbal input with the recognition word set.

2. The apparatus of claim 1, wherein the controller further comprises means for effecting concatenation of the message word set associated with the prompt with a synthesized word set corresponding to at least a portion of the verbal input received by the microphone.

3. The apparatus of claim 1, wherein the prompting means comprises means for producing either one of an audio prompt for broadcasting over the speaker and a visual prompt displayable on the display.

4. The apparatus of claim 1, further comprising mode selection means for selecting either one of a programming mode and a querying mode, the programming mode associated with a plurality of verbal interfacing steps for displaying on the display a parameter representative of the verbal input received from the user, and the querying mode associated with a plurality of verbal interfacing steps for retrieving from the memory previously stored information for broadcasting over the speaker.

5. The apparatus of claim 1, wherein:

each of the plurality of recognition and message word sets comprises discrete validation words associated with a corresponding prompt produced by the prompting means.

6. The apparatus of claim 1, wherein the controller comprises:

means for controlling the prompting means to produce either one of a time prompt and an alarm prompt; and means for transferring between the memory and the voice recognition device a time recognition word set and an alarm recognition word set in response to the time prompt and the alarm prompt, respectively.

7. The apparatus of claim 6, wherein the controller comprises:

means for controlling the prompting means to produce a date prompt; and means for transferring between the memory and the voice recognition device a date recognition word set in response to the date prompt.

8. The apparatus of claim 1, further comprising means for recording and playing back a plurality of personal messages.

9. The apparatus of claim 8, wherein the message recording and playback means comprises:

means for recording the messages delineated by discrete message categories; and means for playing back the messages associated with a user-selected message category.

10. A voice recognition interface for a programmable timekeeping device, comprising:

prompting means for producing a prompt to invoke a verbal input from a user;

a microphone for receiving the verbal input from the user;

a display for displaying time parameters;

a speaker;

a memory for storing a recognition word library;

a voice recognition device; and a controller, coupled to the memory, for controlling the voice recognition device to compare the verbal input with the recognition word library, and for coordinating the display of a time parameter representative of the verbal input on the display in response to a successful comparison of the verbal input with the recognition word library.

11. The apparatus of claim 10, further comprising a message word library stored in the memory, wherein the controller coordinates broadcasting of a message from the message word library over the speaker in response to an unsuccessful comparison of the verbal input with the recognition word library.

12. The apparatus of claim 10, wherein:

the recognition word library comprises a plurality of recognition word sets; and the controller controls the voice recognition device to compare the verbal input with a recognition word set associated with the prompt.

13. The apparatus of claim 10, wherein the programmable timekeeping device is contained in a hingedly closable housing.

14. The apparatus of claim 10, further comprising a time switch and an alarm switch for manually initiating time and alarm functions of the programmable timekeeping device, respectively.

15. The apparatus of claim 10, wherein the prompting means comprises a plurality of annunciators disposed on the display for visually prompting the user for the verbal input.

16. The apparatus of claim 10, further comprising means for recording and playing back a plurality of personal messages.

17. The apparatus of claim 16, wherein the message recording and playback means comprises:

means for recording the messages delineated by discrete message categories; and means for playing back the messages associated with a user-selected message category.

18. A method for verbally interfacing with a programmable timekeeping device having a display, the verbal interfacing method comprising the steps of:

annunciating a user prompt;

receiving a verbal input from a user associated with the user prompt;

comparing the verbal input with a recognition word set associated with the user prompt;

illuminating on the display a character representative of the verbal input in response to a successful comparison of the verbal input to the recognition word set; and broadcasting a message word set associated with the user prompt in response to an unsuccessful comparison of the verbal input to the recognition word set.

19. The method of claim 18, wherein the broadcasting step includes the further step of effecting concatenation of the message word set with a synthesized word set corresponding to at least a portion of the verbal input received from the user.

20. The method of claim 18, wherein the annunciating step includes the further step of illuminating a visual annunciator on the display as the user prompt.

21. The method of claim 18, wherein:

the annunciating step includes the further step of flashing on the display the character associated with the user prompt; and the illuminating step includes the further step of illuminating at a constant illumination state on the display the character representative of the verbal input in response to a successful comparison of the verbal input to the recognition word set.

22. A method as claimed in claim 18, wherein the broadcasting step includes the further step of broadcasting a message word set associated with a status condition of the programmable timekeeping device.

* * * * *